US007882869B2

(12) United States Patent
Kube et al.

(10) Patent No.: US 7,882,869 B2
(45) Date of Patent: Feb. 8, 2011

(54) REPLACEABLE FLUTE INSERTS FOR A ROLLER ASSEMBLY OF A DEBARKER APPARATUS

(75) Inventors: Burk R. Kube, Surrey (CA); Douglas B. Jeffrey, Victoria (CA); Marek S. Cholewczynski, Victoria (CA)

(73) Assignee: Nicholson Manufacturing Ltd., Sidney (CA)

( * ) Notice: Subject to any disclaimer, the term of this patent is extended or adjusted under 35 U.S.C. 154(b) by 899 days.

(21) Appl. No.: 11/698,790

(22) Filed: Jan. 26, 2007

(65) Prior Publication Data

US 2008/0178965 A1 Jul. 31, 2008

(51) Int. Cl.
*B27L 1/00* (2006.01)

(52) U.S. Cl. ..... 144/208.1; 144/208.8

(58) Field of Classification Search ..... 144/208.1, 144/208.4, 208.5, 108.8, 208.9, 246.1, 248.7, 144/248.5; 492/28, 30, 31, 32, 33, 34, 35, 492/36, 39, 40, 48, 49; 198/624, 292, 780
See application file for complete search history.

(56) References Cited

U.S. PATENT DOCUMENTS

| | | | | | |
|---|---|---|---|---|---|
| 1,830,145 | A | * | 11/1931 | Vieck | 101/171 |
| 2,261,893 | A | * | 11/1941 | Wolfard | 404/124 |
| 2,726,691 | A | * | 12/1955 | Gordon et al. | 144/208.4 |
| 3,594,096 | A | * | 7/1971 | Scharffenberg-Kahlke | 416/84 |
| 3,681,803 | A | * | 8/1972 | Pisaroni | 12/29 |
| 3,833,162 | A | | 9/1974 | Sato | 226/184 |
| 4,057,192 | A | * | 11/1977 | Smith | 241/92 |
| 4,385,650 | A | | 5/1983 | Schmidt | 144/246 C |
| 4,431,039 | A | * | 2/1984 | Barwise et al. | 144/176 |
| 4,454,900 | A | * | 6/1984 | Hayes | 144/213 |
| 4,721,139 | A | | 1/1988 | Peterson et al. | 144/246 C |
| 4,901,778 | A | * | 2/1990 | Fenton | 144/230 |
| 5,022,446 | A | * | 6/1991 | Wingate-Hill et al. | 144/208.4 |
| 5,111,860 | A | * | 5/1992 | Wingate-Hill et al. | 144/208.4 |
| 5,152,328 | A | | 10/1992 | Arvidsson | 144/246 A |
| 5,419,106 | A | * | 5/1995 | Gemelli | 56/16.4 B |
| 5,797,438 | A | * | 8/1998 | Dye | 144/246.1 |
| 5,944,078 | A | | 8/1999 | Lindholm | 144/248.5 |
| 5,957,177 | A | * | 9/1999 | Smith et al. | 144/248.7 |
| 5,960,931 | A | * | 10/1999 | Nilsson | 198/624 |
| 6,253,813 | B1 | | 7/2001 | Kube et al. | 144/248.5 |
| 6,394,259 | B1 | * | 5/2002 | Alhainen | 198/692 |
| 6,422,277 | B1 | | 7/2002 | Kube et al. | 144/246.1 |
| 6,453,959 | B1 | * | 9/2002 | Johnson et al. | 144/246.1 |
| 6,481,471 | B1 | * | 11/2002 | Johnson et al. | 144/246.1 |
| 6,684,923 | B1 | * | 2/2004 | Isley | 144/248.7 |
| 6,705,455 | B2 | * | 3/2004 | Lin | 198/722 |
| 7,565,921 | B2 | * | 7/2009 | Roy | 144/246.1 |
| 2005/0020422 | A1 | * | 1/2005 | Betti et al. | 492/56 |

* cited by examiner

*Primary Examiner*—Dana Ross
*Assistant Examiner*—Jennifer Chiang
(74) *Attorney, Agent, or Firm*—Seed Intellectual Property Law Group PLLC

(57) ABSTRACT

Apparatuses, systems, and methods for transporting logs through a debarker are shown and described. The disclosed embodiments of roller assemblies can be used for quickly and conveniently moving logs along a processing line. Some disclosed embodiments include fluted rollers that carry replaceable inserts. The inserts can protect the logs and the rigid flutes of the roller. The insert can be made of a wear resistant material for a prolonged life. A worn insert can be replaced with another insert to ensure proper functioning of the roller assemblies.

14 Claims, 18 Drawing Sheets

REPLACEABLE FLUTE INSERTS FOR A ROLLER ASSEMBLY OF A DEBARKER APPARATUS

BACKGROUND OF THE INVENTION

1. Technical Field

The present disclosure in some embodiments generally relates to a roller assembly, and more specifically to a roller assembly having replaceable flute inserts.

2. Description of the Related Art

Debarker apparatuses often have upper and lower spaced pairs of fluted rolls for moving logs along a processing line. These fluted rolls are commonly at the infeed and/or outfeed sections of the processing line. Flutes on the rolls are often arranged and shaped to grip and propel the logs forward as the rolls rotate. This is often accomplished by having sets of right and left complementing metal flutes meeting at the center of each roll. Each flute has an inner end displaced circumferentially along the roll from an outer end so that, when viewed in elevation, the complementing flutes have a generally "V" shaped configuration.

Central portions of the flutes often provide most of the traction for advancing the log and are commonly provided with a serrated configuration or spikes to better grip the log. Accordingly, the central portions are subject to most of the wear and must be replaced from time to time. Unfortunately, to accomplish this repair the roll typically must be removed from the debarker apparatus. The worn flutes are then removed, which is a relatively difficult task because the flutes are often welded to a cylindrical body of the roll.

The flutes (e.g., serrated metal flutes) may also damage logs thereby reducing the amount of material suitable for making lumber or other wood products. When the logs impact the flutes, for example, the ends of the logs may be damaged. The metal flutes can often remove chucks of wood from the logs, thus reducing the amount of useable wood. Thus, traditional fluted rolls may be unsuitable for processing logs.

BRIEF SUMMARY

Some embodiments disclosed herein include the realization that rollers of debarkers can have one or more replaceable flute inserts. The flute inserts can be positioned between flutes fixedly coupled to a roller and can minimize, limit, or substantially prevent damage to log ends. If the flute inserts are not performing properly, the inserts can be quickly replaced. After the inserts have been worn a predetermined amount, for example, the inserts can be quickly replaced resulting in less machine downtime. The inserts can provide suitable high wear surfaces, edges, or other contact regions for engaging logs.

The inserts can cushion the logs when the logs engage the rollers. In some embodiments, a buffer of the insert receives the log upon initial impact. The buffer then guides the log along the roller. During this process, the buffer can protect the log from the rigid underlying flutes on the roller that would otherwise damage (e.g., chew up) the log. Even though the buffer may be somewhat compressible, the buffer may effectively limit slipping between the roller and the log.

In one embodiment, a roller assembly of a log debarker system includes a rotatable roller having a first roller end, a second roller end opposing the first roller end, and an outer surface extending longitudinally between the first roller end and the second roller end. Two complementing series of flutes are spaced longitudinally apart from each other and coupled to the outer surface of the roller. Two complementing series of flute anchor members are coupled to the outer surface and positioned between the two series of flutes. Each flute anchor member has a first anchor section, a second anchor section, and a central anchor section interposed between the first anchor section and the second anchor section. The central anchor section is advanced circumferentially of the first anchor section and the second anchor section. A series of replaceable flute inserts each having a base and a buffer is provided. The base is coupled to at least one of the first and second flute anchor members such that the buffer extends outwardly beyond adjacent flute anchor members. The buffer comprises a non-metal material that is sufficiently compressible to accommodate a periphery of a log when the flute insert contacts a log.

In some embodiments, a roller assembly for a debarker system includes a roller having a rotary axis and a plurality of flute assemblies circumferentially spaced about and fixedly coupled to the roller. Each adjacent pair of flute assemblies defines a receiving gap. A plurality of replaceable flute inserts is configured to engage logs and positioned within corresponding receiving gaps. Each flute insert extends circumferentially between adjacent flute assemblies and longitudinally along at least a portion of the receiving gap. A compressible portion of the flute insert extends radially outward beyond adjacent flute assemblies such that the compressible portion can first accommodate a periphery of the log.

In yet another embodiment, a replaceable insert for use on a debarker roll having a plurality of flute elements is configured to couple to the roll and includes a first elongate arm having a first outer end and a first inner end. The first elongate arm extends along a first longitudinal axis between the first outer end and the first inner end. A second elongate arm has a second outer end and a second inner end. The second elongate arm extends along a second longitudinal axis between the second outer end and the second inner end. The second longitudinal axis is not parallel to the first longitudinal axis. A central portion is interposed between the first inner end and the second inner end. The first elongate arm, second elongate arm, and central portion cooperate to define an outer engagement face that faces outwardly when the insert is installed in the debarker roll.

In still another embodiment, a replaceable insert for use on a fluted roller having a plurality of anchoring elements includes a base coupleable to the fluted roller. A buffer is coupleable to the base and defines an outer face for engaging a log. At least a portion of the outer face is formed of a compressible material such that the at least a portion of the outer face is conformable to an outer surface of log when the base is coupled to the fluted roller.

In yet another embodiment, an insert for use on a fluted roller is provided. The insert includes a base member coupleable to the fluted roller. A cover is coupleable to the base. At least a portion of the cover is formed of a compressible material such that the at least a portion of the cover can conform to an outer surface of log when the base is coupled to the fluted roller. The cover can be a buffer or other suitable engagement device.

DETAILED DESCRIPTION

The present detailed description is generally directed to a debarker apparatus with one or more pairs of roller assemblies, each having a rotatable fluted roller carrying a plurality of replaceable flute inserts. Many specific details of certain exemplary embodiments are set forth in the following description and in FIGS. 1-18 to provide a thorough understanding of such embodiments. One skilled in the art, however, will understand that the disclosed embodiments may be practiced without one or more of the details described in the following description. Additionally, the roller assemblies are discussed in the context of log debarkers because they have particular utility in this context. For example, the roller assemblies are particularly well suited for use at the infeed section, outfeed section, or any other location along a process line of a debarker. If the roller assemblies are positioned at the infeed section, the roller assemblies can be feed roll assemblies that push logs into a debarking section of the debarker. The debarking section then removes bark from the logs. However, the roller assemblies can be used in other contexts, such as, for example, in systems (e.g., press systems, slicing systems, and the like) that receive, transport, and/or process lumber, columns (e.g., wood or metal columns or poles), and other elongated members.

It should be noted that, as used in this specification and the appended claims, the singular forms "a," "an," and "the" include plural referents unless the content clearly dictates otherwise. It should also be noted that the term "or" is generally employed in its sense including "and/or" unless the content clearly dictates otherwise. For purposes of this description and for clarity, a debarker apparatus will be described, and then a description of a roller assembly and its components will follow.

Figure 1:
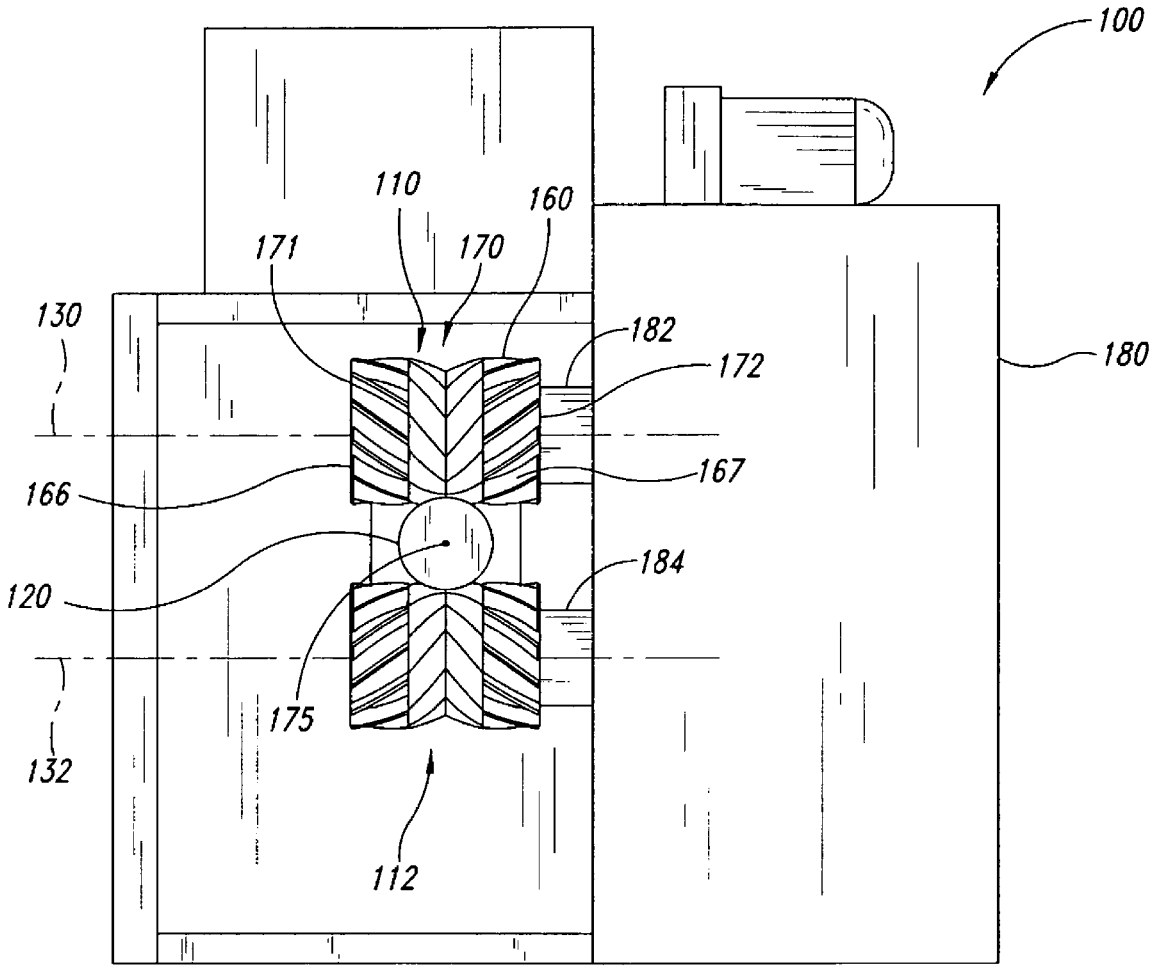
FIG. 1 is a front elevational view of a debarker apparatus having a pair of fluted roller assemblies, according to one embodiment.

FIG. 1 illustrates a debarker apparatus 100 including a pair of roller assemblies 110, 112 for receiving and transporting a log 120. The spaced apart roller assemblies 110, 112 are rotatable about axes of rotation 130, 132, respectively. To move the log 120 lengthwise along a processing line 175 (as indicated by an arrow 138 shown in FIG. 3), the roller assembly 110 is rotated counterclockwise about the axis 130 (indicated by the arrow 140 of FIG. 3), while the roller assembly 112 is rotated clockwise (indicated by the arrow 143 of FIG. 3). The illustrated roller assemblies 110, 112 can be generally similar to each other and, accordingly, the following description of the one of the roller assemblies applies equally to the other, unless indicated otherwise.

Figure 2:
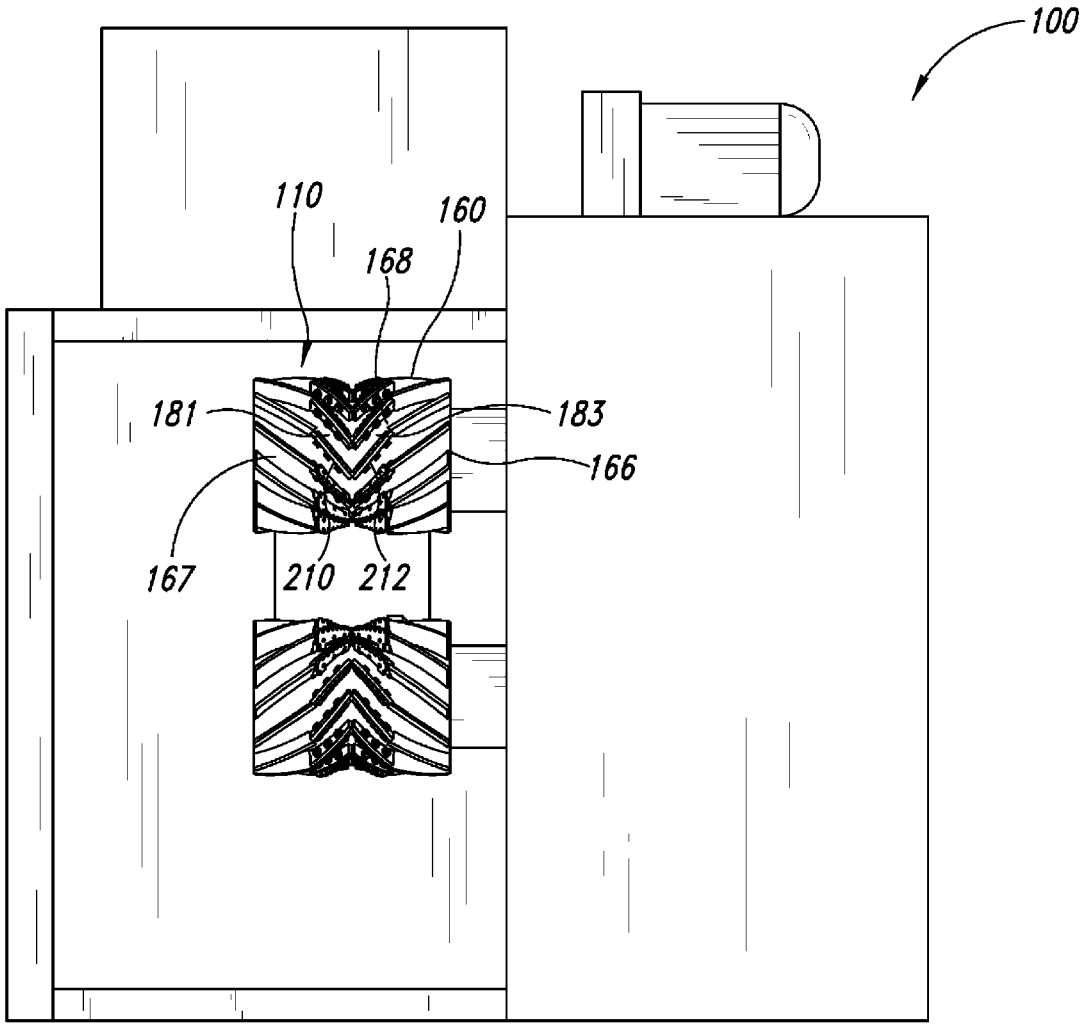
FIG. 2 is a front elevational view of the debarker apparatus of FIG. 1, where inserts have been removed from the fluted roller assemblies.
Figure 3:
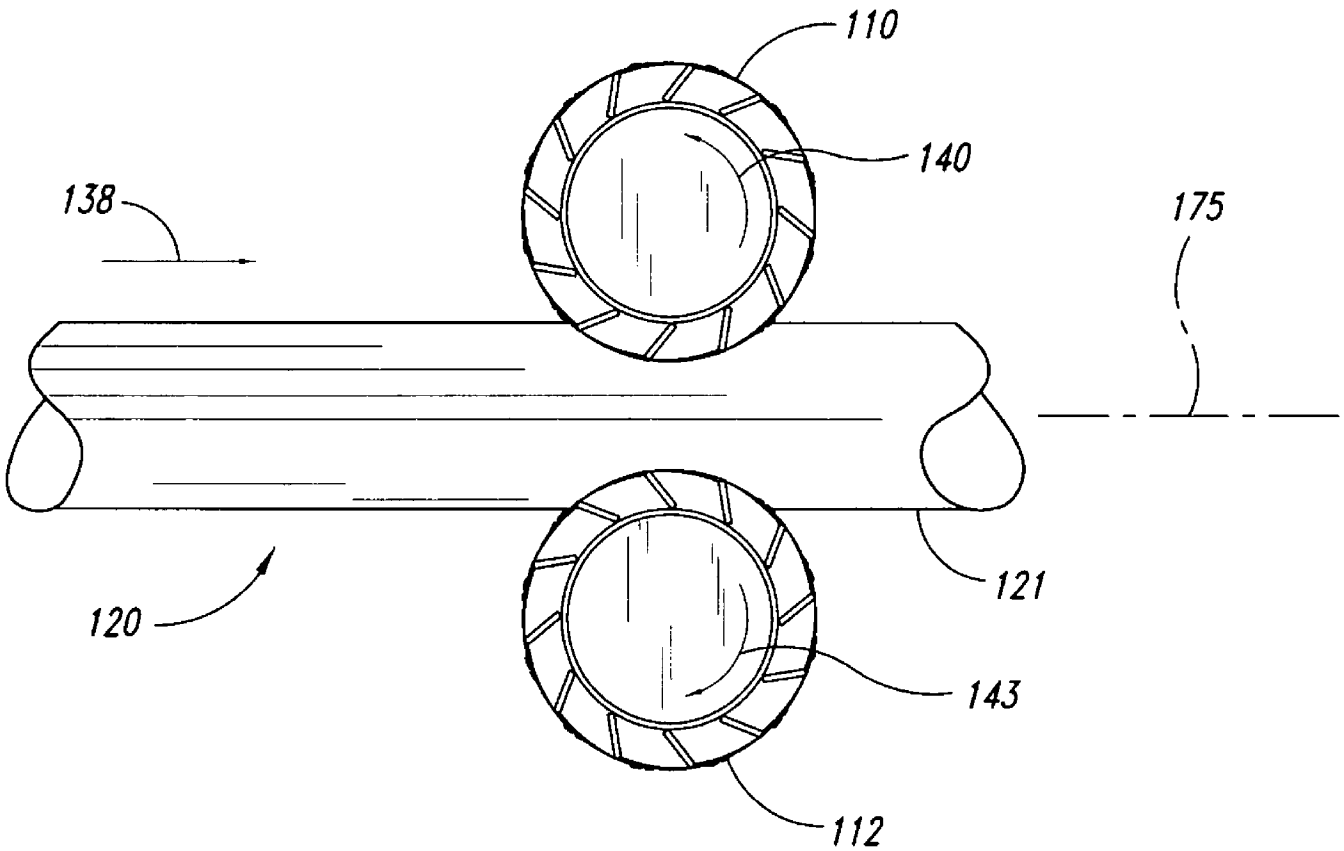
FIG. 3 is a side elevational view of a log interposed between a pair of fluted roller assemblies.

With reference to FIGS. 1 and 2, the roller assembly 110 includes a plurality of traction flute assemblies 160 spaced circumferentially from each other about a cylindrical roller body 166. The illustrated flute assemblies 160 are generally V-shaped (viewed in elevation) and extend radially outward from an outer surface 167 of the roller body 166. The traction flute assemblies 160 can be temporarily or permanently coupled to the outer surface 167.

With continued reference to FIG. 1, the roller assembly 110 carries an array of replaceable flute inserts 170. In the illustrated embodiment, each adjacent pair of flute assemblies 160 has interposed therebetween one of the inserts 170. The flute assemblies 160 can define gaps 168 sized to receive the inserts 170 having various configurations.

The illustrated inserts 170 of FIG. 1 are generally V-shaped (viewed in elevation) and dimensioned to fit in the complementary V-shaped gaps 168 with a first passageway 181 and a second passageway 183, as shown in FIG. 2. Thus, the shape of the inserts 170 can generally match the shape of the flute assemblies 160. During operation, the inserts 170 can protect and limit or substantially prevent damage to the log ends. Upon initially contacting the inserts 170, the inserts 170 can be compressed thereby exposing traction elements, spikes (preferably metal spikes), or serrated edges of the flute assemblies 160 in order to grip and propel the log 120 through the debarker apparatus 100. During this process, the roller assemblies 110, 112 can cooperate to center the log 120 to ensure proper transport between the roller assemblies 110, 112.

With continued reference to FIG. 1, the inserts 170 are positioned somewhat midway between ends 171, 172 of the roller body 166 such that off fed logs still engage the inserts 170. This ensures that the logs remain in contact with the inserts 170 even if the logs are skewed relative to the processing line 175. Advantageously, the inserts 170 can be replaced when worn, or removed to perform maintenance, for example. When the inserts 170 are removed, as shown in FIG. 2, the central portions of the flute assemblies 160 are exposed. (In some versions, the inner flute members 210, 212 shown in FIG. 2 are removed as a unit or separately along with the inserts 170.)

The debarker apparatus 100 of FIG. 1 also includes a drive system 180 for controllably rotating the roller assemblies 110, 112. The drive system 180 can have vertically spaced drive assemblies 182, 184 mechanically coupled to the roller assemblies 110, 112, respectively. The roller assemblies 110, 112 can have mounting flanges, mounting plates, or other suitable structures for coupling to the drive system 180. Other types of standard drive arrangements for debarker roller assemblies can also be used. The illustrated roller assemblies 110, 112 are oriented generally horizontally. In other uses, the roller assemblies 110, 112 can be in other orientations, especially when the log 120 is supported by another device.

Figure 4:
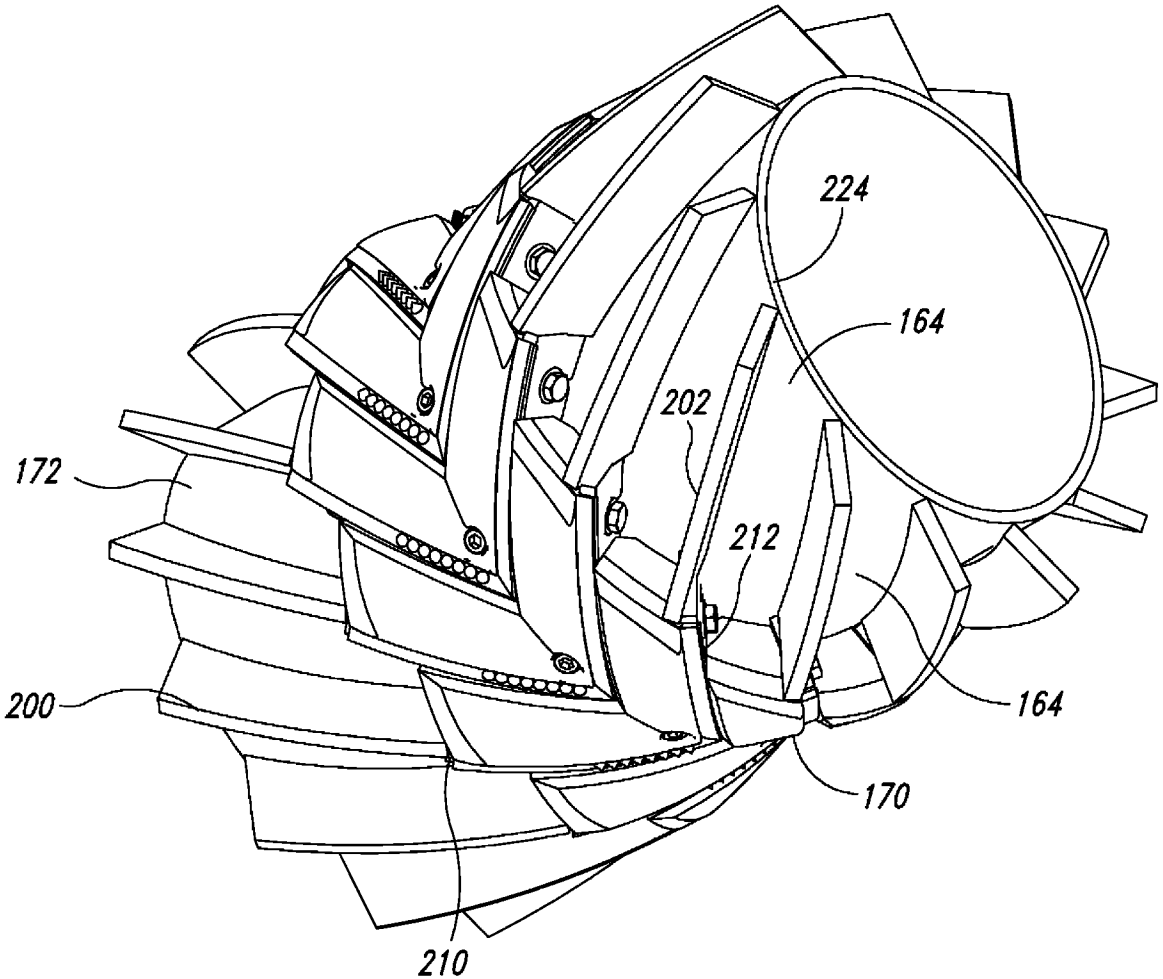
FIG. 4 is a pictorial view of a roller assembly of the debarker apparatus of FIG. 1, according to one embodiment.

FIG. 4 illustrates the flute assemblies 160 carrying the inserts 170. Each flute assembly 160 includes a pair of outer flutes 200, 202 and a pair of anchor members 210, 212 between the outer flutes 200, 202 in a side-by-side arrangement. In the illustrated embodiment, two complementary sets of anchor members 210, 212 are interposed between corresponding complementary sets of outer flutes 200, 202.

Figure 5:
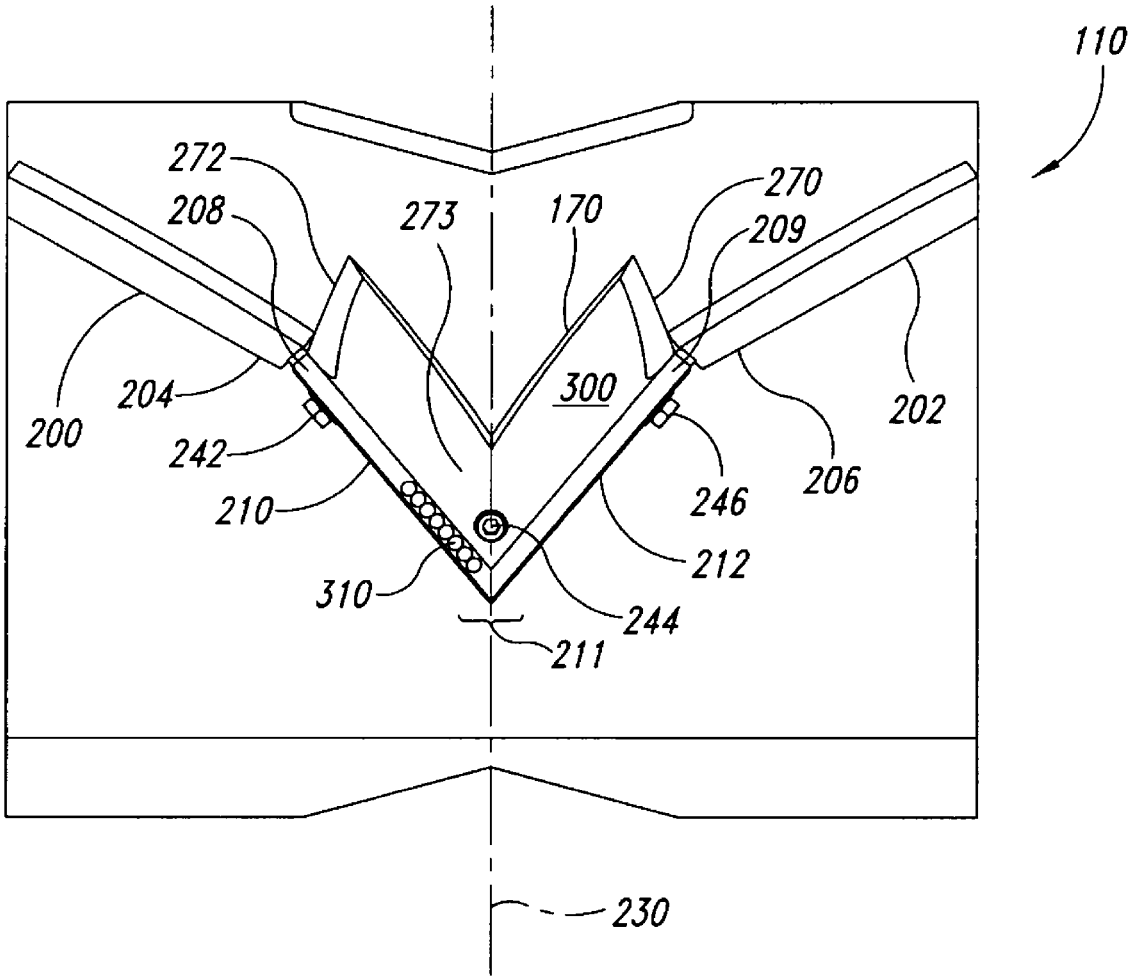
FIG. 5 is a front elevational view of the flute roller assembly of the debarker apparatus of FIG. 1, according to one embodiment.

As shown in FIG. 5, the outer flutes 200, 202 are mirror images of one another and have a curved shaped complementary to the outer surface 167. The anchor members 210, 212 are also mirror images of one another and have a curved shaped complementary to the outer surface 167. Inner ends 204, 206 of the outer flutes 200, 202 are proximate the corresponding outer ends 208, 209 of the anchor members 210, 212. The anchor members 210, 212 are in a generally V-shaped configuration. A central section 211 of the anchor members 210, 212 is advanced circumferentially of the ends 208, 209. Additionally, the anchor members 210, 212 can have a one-piece or multi-piece construction. In multi-piece embodiments, each of the anchor members 210, 212 is formed of an elongated strip (e.g., a strip of metal). In one-piece embodiments, the anchor members 210, 212 are formed by an elongated, angled strip of metal. Other materials can also be used to form the anchoring members 210, 212.

The flute assemblies 160 can likewise have a one-piece or multi-piece construction. In some one-piece embodiments, the flute assemblies 160 have anchor members 210, 212 integrally formed with the outer flutes 200, 202. For example, an elongated, continuous strip of metal can form the outer flutes 200, 202 and anchor members 210, 212.

As shown in FIG. 5, a center plane 230 can be positioned generally between the anchor members 210, 212. Each adjacent pair of circumferentially spaced anchor members 210, 212 has interposed therebetween one of the inserts 170. The inserts 170 are fixedly coupled to the anchor members 210, 212, which are in turn fixedly coupled to the cylindrical roller body 166. In this manner, the inserts 170 are securely coupled to the flute assemblies 160.

The inserts 170 can be somewhat compressible to cushion the log 120 upon initial impact, thus limiting, minimizing, or substantially preventing damage to an end 121 of the log 120. Advantageously, a wide range of feed rates can be used without significantly impacting the performance of the debarker 100. For example, the log 120 can be delivered at a high line speed without appreciably damaging the leading end 121 (FIG. 3) of the log 120 thereby increasing the number of processed logs and amount of useable wood in each log. The inserts 170 effectively absorb a sufficient amount of the impact forces to keep damage to the log 120 below a desired level. Traditional rollers can have flutes made entirely of metal, such as steel. These metal flutes can chew-up, scrape, or otherwise mar logs, especially logs fed at high line speeds, thereby reducing the amount of wood suitable for producing lumber.

After the roller assemblies 110, 112 receive the log 120, the inserts 170 can provide sufficient frictional interaction with the log 120 so as to limit, minimize, or substantially prevent any slipping (e.g., linear and/or rotational movement of the log 120) with respect to the inserts 170. The frictional interaction therefore ensures that the log 120 can be quickly and efficiently moved through the debarker apparatus 100. When the opposing inserts 170 on the rotating roller assemblies 110, 112 are compressed against the log 120, the inserts 170 snugly hold the log 120.

The log 120 can compress the inserts 170 to expose the rigid flute assemblies 160, which may provide a sufficient amount of traction to effectively move the log 120 along the processing line 175. The flute assemblies 160 can thus grip, center, and propel the log 120. One of ordinary skill in the art can select the designs of the flute assemblies 160 and inserts 170 to achieve the desired interaction with the log 120.

After the inserts 170 disengage the log 120, the inserts 170 can return to their original uncompressed configurations. Additionally or alternatively, the inserts 170 can dampen vibrations producing reduced cyclic loading for an improved fatigue life. The dampening facilitates smooth movement of the log 120 through the debarker apparatus 100.

With continued reference to FIG. 5, fasteners 242, 246 removably couple the insert 170 to the anchor members 210, 212, respectively. The fastener 244 couples the insert 170 to the roller body 166 of the roller assembly 110. The term "fastener" is a broad term and generally refers, without limitation, to one or more devices or structures that are capable of coupling the flute insert 170 to the roller assembly 110 during normal use. A fastener can include; but is not limited to, one or more nut/bolt assemblies, pin/rod assemblies, threaded members, screws, nuts, combinations thereof, and the like. As used herein, the term "bolt" is to be construed broadly and may include, without limitation, an externally threaded fastener that can be inserted through a hole (e.g., a circular hole, elliptical hole, and the like) and configured to receive a threaded nut. A bolt, in some embodiments, may have a head (e.g., a hexagonal head, square head, slotted head, etc.) that engages the surface of one of the anchor members 210, 212 or insert 170.

Figure 6:
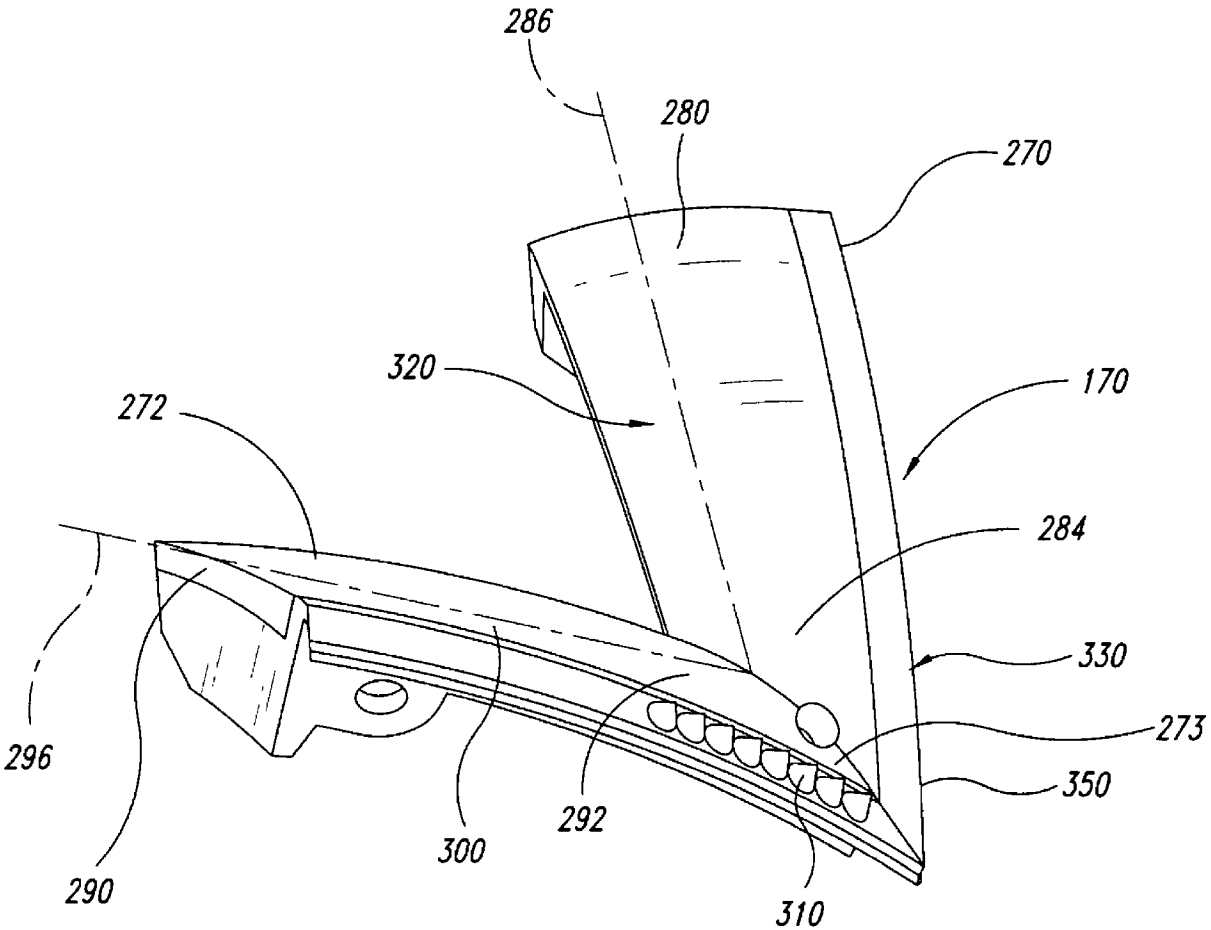
FIG. 6 is a pictorial view of an insert for a flute roller assembly, according to one embodiment.
Figure 7:
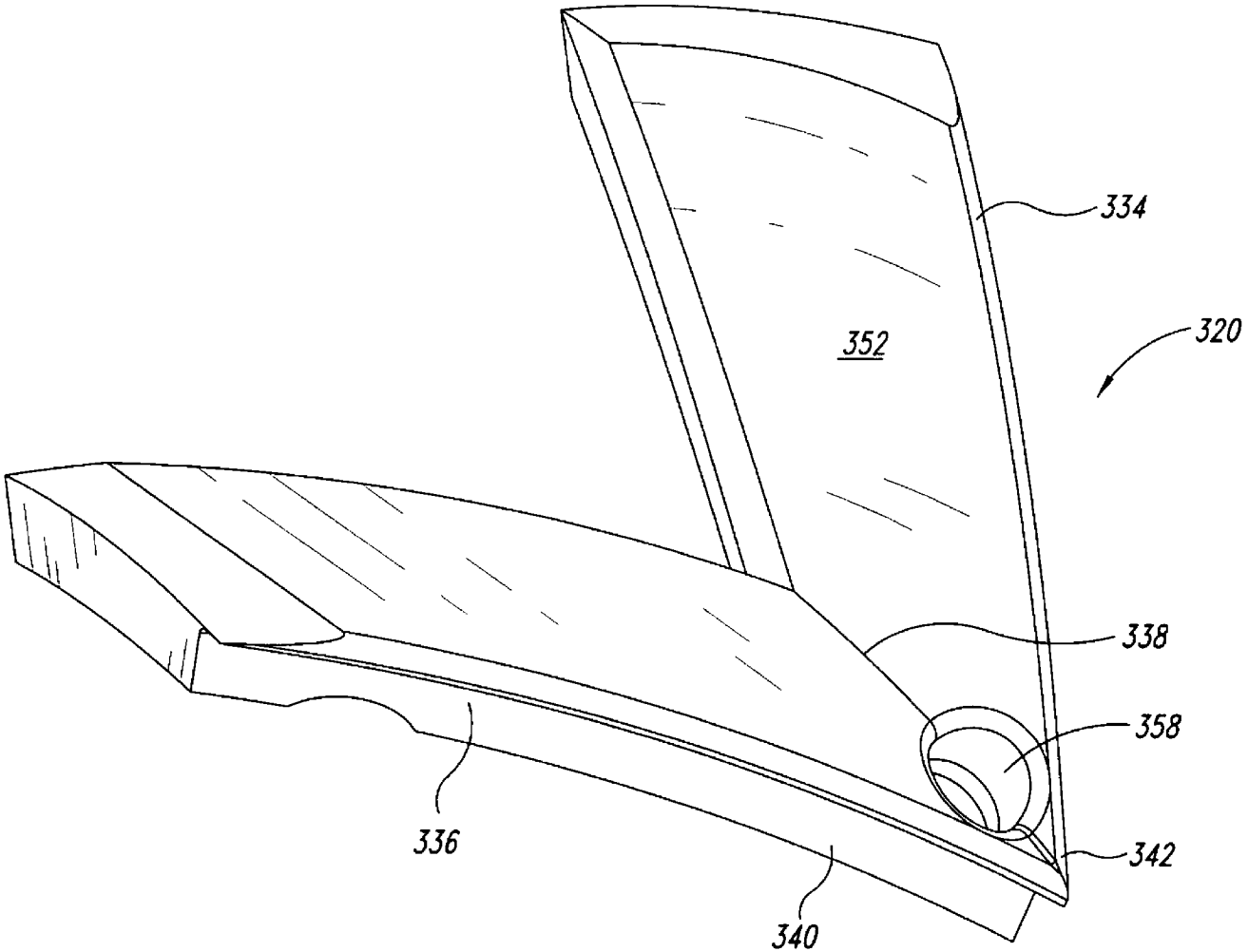
FIG. 7 is a pictorial view of a buffer of the insert of FIG. 6.

With reference to FIGS. 5 and 6, the insert 170 includes a first elongate arm 270, a second elongate arm 272, and a central portion 273 extending uninterruptedly between the first and second elongate arms 270, 272. As shown in FIG. 6, the first elongate arm 270 has a first outer end 280 and a first inner end 284. The elongate arm 270 extends along a longitudinal axis 286 from the first outer end 280 to the first inner end 284. Similarly, the second elongate arm 272 includes a second outer end 290 and a second inner end 292. The second elongate arm 272 extends along a longitudinal axis 296 from the second outer end 290 to the second inner end 292.

In the illustrated embodiment, the longitudinal axis 286 of the first elongate arm 270 is not parallel to the longitudinal axis 296 of the second elongate arm 272. The angle defined between the longitudinal axes 286, 296 can be at least 30 degrees, 50 degrees, 60 degrees, 70 degrees, 90 degrees, 100 degrees, 120 degrees, and ranges encompassing such angles. The central portion 273 is formed, at least in part, by the first inner end 284 and the second inner end 292. In the illustrated embodiment, the first elongate arm 270, second elongate arm 272, and central portion 273 cooperate to define an engagement face 300 that faces outwardly when the insert 170 is installed, as shown in FIG. 5. Because the insert 170 extends continuously and uninterruptedly between the outer ends 280, 290, the insert 170 provides a relatively large engagement face 300 for contacting logs. The enlarged engagement face 300 can effectively distribute applied compressive stresses to the log 120 to limit or substantially prevent localized permanent deformation of the log 120. The illustrated engagement face 300 is generally partially cylindrical so as to be somewhat concentric with the outer surface 164. Other configurations are also possible. For example, the engagement face 300 can be located further outward, radially, than the outer surfaces of the anchor members 210, 212, causing the log 120 to contact the engagement face 300 before contacting the anchor members 210, 212, further reducing the likelihood of damage to the log 120.

Various types of inserts 170 can be used. The inserts 170 can be generally V-shaped, U-shaped, W-shaped, or have any other suitable shape for being received in the gap 168. Based on the configuration of the gaps 168, one of ordinary skill can determine an appropriate configuration of the inserts 170. The illustrated V-shaped inserts 170 are somewhat curved to generally match the curvature of the outer surface 167. The installed inserts 170 can rest against the outer surface 164, which can help apply compressive forces to the log 120 via the inserts 170.

As shown in FIGS. 5 and 6, the insert 170 can have one or more traction elements 310 configured to engage the log 120. The illustrated array of traction elements 310 are in the form of conical protrusions. Any number of traction elements 310 can be positioned at any suitable location along the insert 170 for engaging the log 120. Teeth, surfaces treatments (e.g., grooves, knurling, serrations, rougheners, and the like), protrusions, spikes, or any other suitable traction means can be used to provide the desired frictional interaction between the insert 170 and log 120, as indicated above. In other embodiments, the insert 170 may not have any traction elements 310. In such embodiments, the roller assemblies 110, 112 can be spaced apart such that the log 120 is securely gripped between opposing inserts 170 during the transport process.

The traction elements 310 can be at other locations on the feed roller assemblies 110, 112. To enhance interaction with the flute assemblies 160, for example, the traction elements 310 can be fixedly coupled to outwardly facing surfaces of the flute assemblies 160. Other components of the roller assemblies 110, 112 can also be provided with the traction elements 310.

With continued reference to FIG. 6, the insert 170 includes a buffer 320 removably or permanently coupled to a base 330. Generally, at least a portion of the buffer 320 extends radially beyond adjacent flute assemblies 160 in order to receive the log 120. When the insert 170 receives the log 120, the buffer 320 can be compressed radially inward as it applies compressive forces to the log 120. Even so, the buffer 320 can still extend radially beyond the adjacent flute assemblies 160, thus preventing the log 120 from the contacting the flute assemblies 160. As such, the buffers 320 limits or prevents direct physical contact between the log 120 and flute assemblies 160, which may otherwise damage the log 120.

Figure 8:
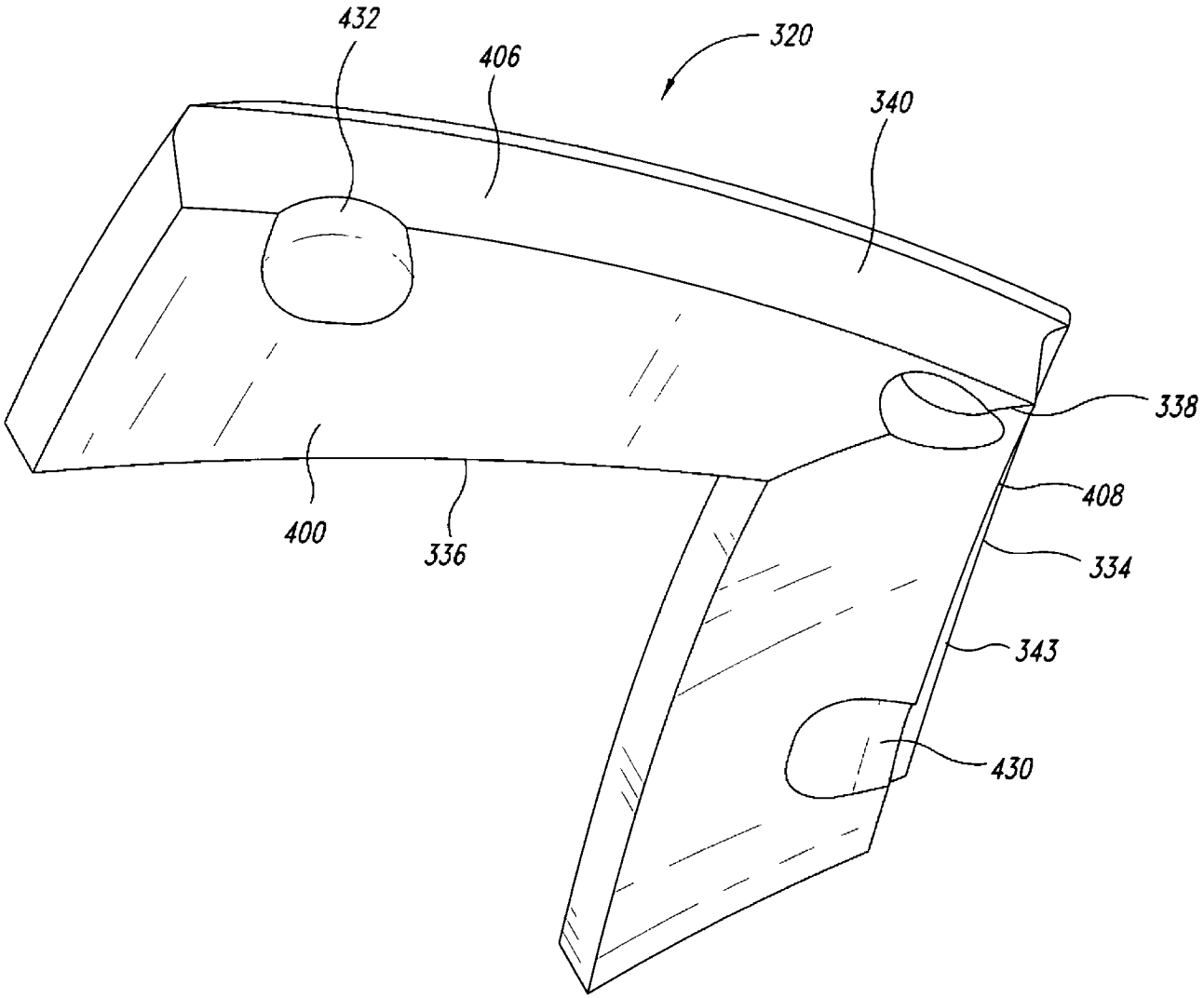
FIG. 8 is another pictorial view of the buffer of FIG. 7.
Figure 9:
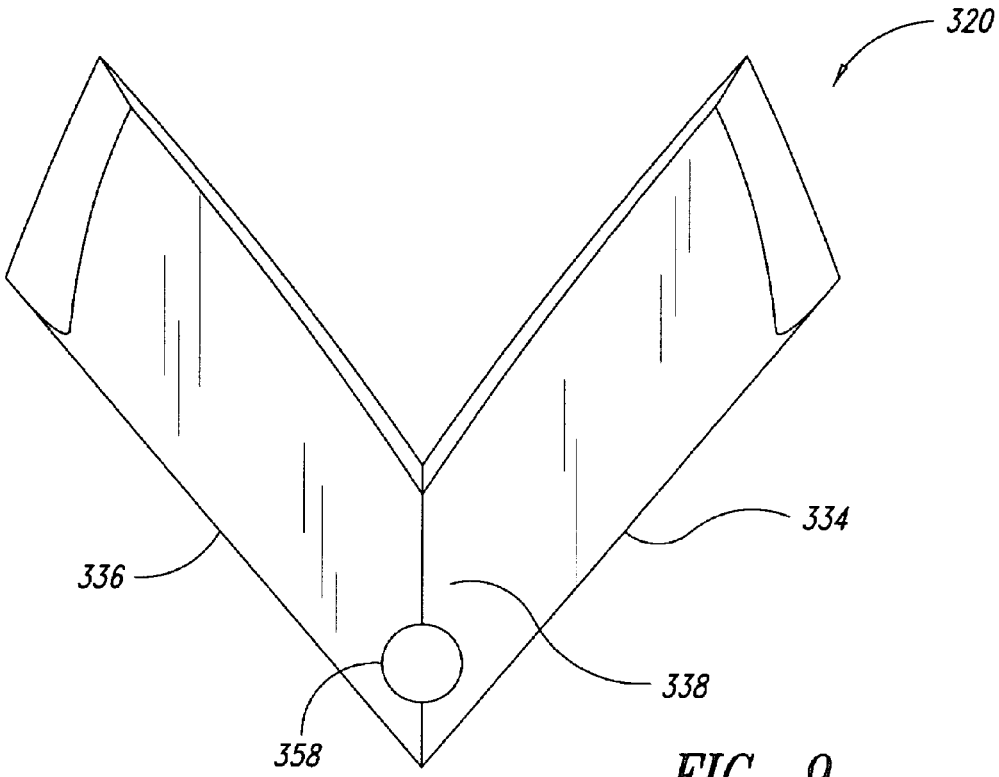
FIG. 9 is a top elevational view of the buffer of FIG. 7.
Figure 10:
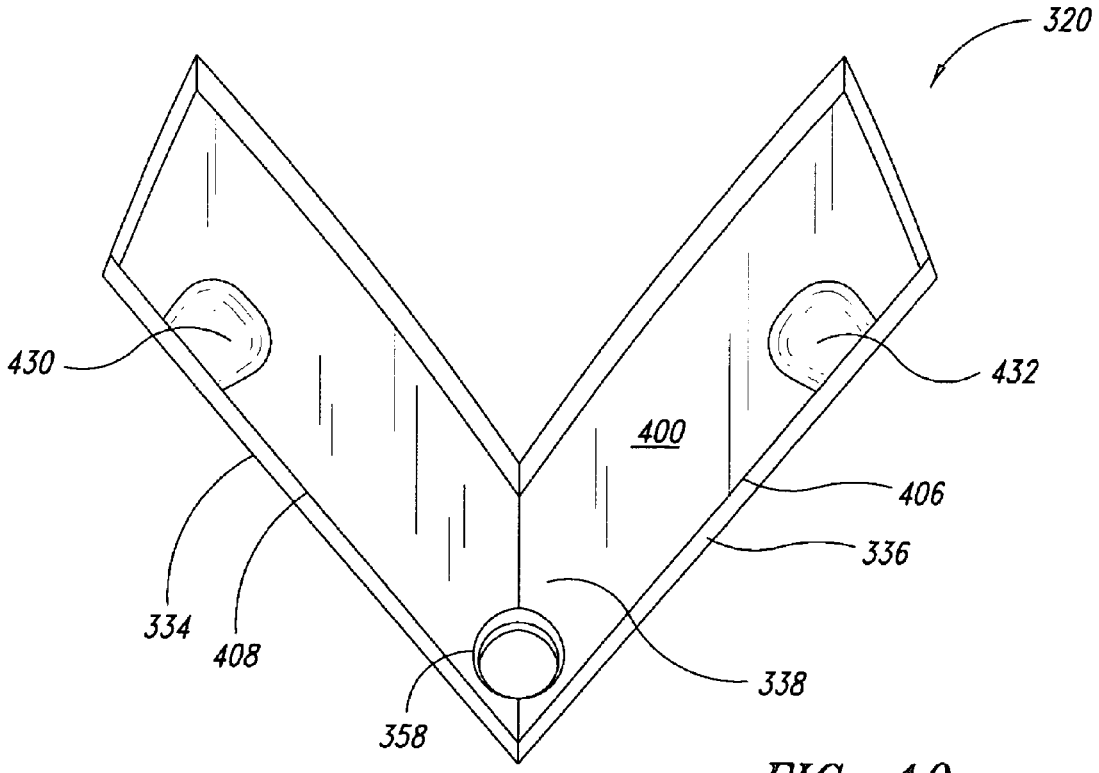
FIG. 10 is a bottom elevational view of the buffer of FIG. 7.
Figure 11:
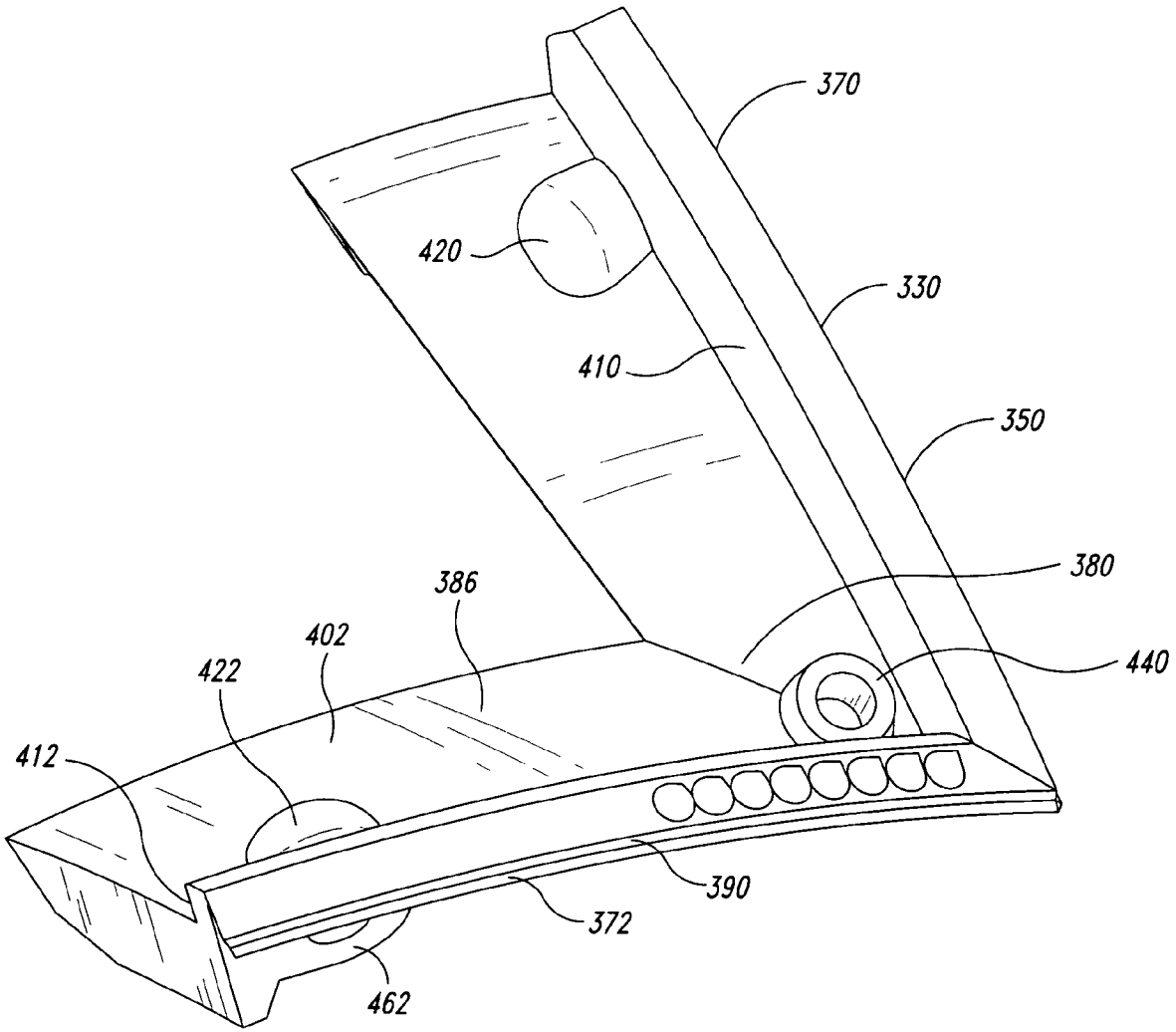
FIG. 11 is a pictorial view of a base of the insert of FIG. 6.
Figure 12:
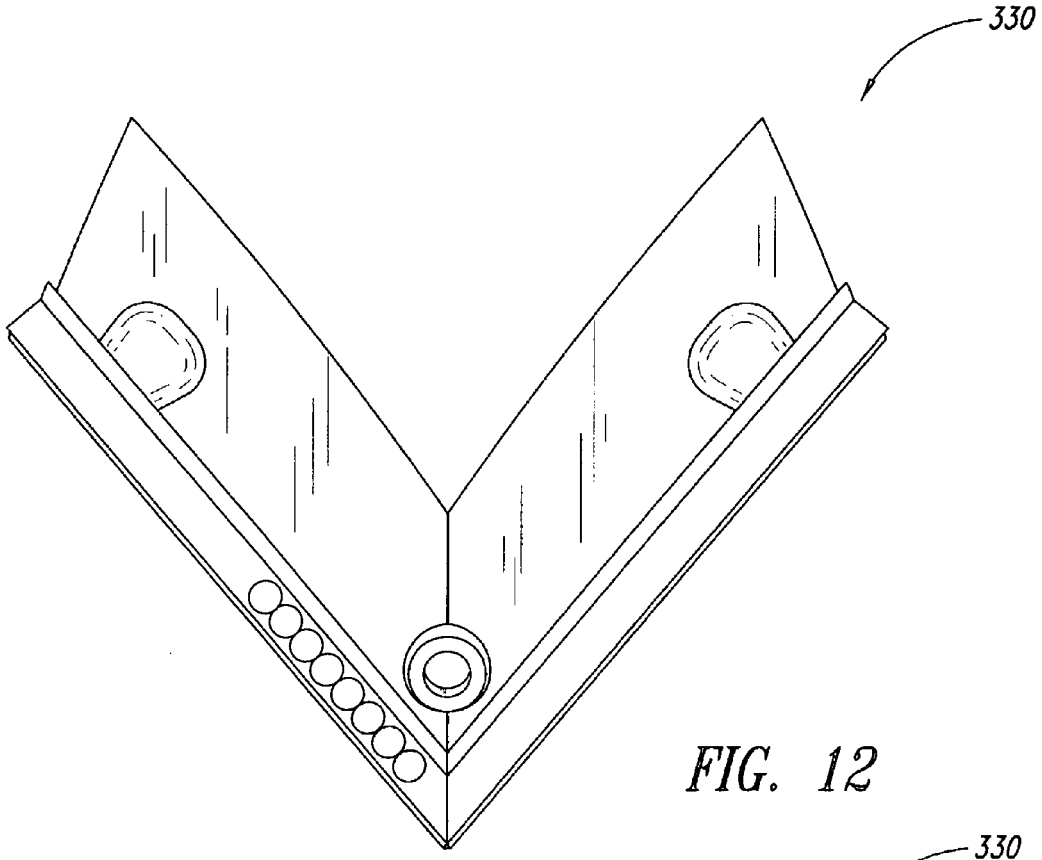
FIG. 12 is a top elevational view of the base of FIG. 11.

FIGS. 7 to 10 illustrate the buffer 320 having a generally V-shaped configuration. The illustrated buffer 320 includes a pair of elongate buffer elements 334, 336 extending outwardly from a buffer central portion 338. An outwardly extending mounting portion 340 is dimensioned to fit within a base receiving portion 386 of the base 330 (FIG. 11). An outwardly extending lip 343 of FIG. 8 is configured to overlay at least a portion of an outwardly extending flange 390 (see FIG. 6) of the base 330.

For convenient installation, the buffer 320 can also include an aperture 358 sized and dimensioned to receive a fastener. As shown in FIG. 5, for example, the fastener 244 can extend through the aperture 358 to fixedly couple the buffer 320 to the roller 110. The shape and dimension of the aperture 358 can be selected based on the type of fastener utilized.

Various types of materials can be used to form the buffer 320. In some embodiments, the buffer 320 can comprise a somewhat compressible material that conforms about the outer surface of the log 120. As used herein, the term "compressible material" is a broad term that may include, without limitation, materials that are generally more compliant than wood, such as oak, pine, cedar, or other types of wood that are typically subjected to a debarking process. For example, the compressible material can have a modulus of elasticity equal to or less than the wood to be debarked. In some embodiments, the compressible material can have a modulus of elasticity less than the modulus of elasticity of steel and, thus, may produce less damage to the log as compared to steel flutes. As such, the compressible material can be readily deformed to conform to irregular surfaces of the logs without appreciably deforming the periphery of the logs. In some embodiments, the compressible material can elastically deform for repeated use.

The insert 170 can comprise one or more materials selected from one or more non-metals, metals (e.g., steel, aluminum, titanium, and the like), composites, polymers, alloys, foams, rubbers, thermoplastics, thermosets, elastomers, combinations thereof, and other materials suitable for engaging logs. In some non-limiting exemplary embodiments, the insert 170 and/or buffer 320 can be formed, in whole or in part, of a non-metal material (e.g., a polymer or plastic, such as polyurethane). In some embodiments, the insert 170 and/or buffer 320 comprises more than about 40% by weight of a non-metal material. In some embodiments, the insert 170 and/or buffer 320 comprises more than about 60% by weight of a non-metal material. In some embodiments, the insert 170 and/or buffer 320 comprises more than about 80% by weight of a non-metal material. In some embodiments, the insert 170 comprises mostly a non-metal material. In such embodiments, the insert 170 and/or buffer 320 can absorb enough energy to appreciably minimize or limit damage to the log while providing enough frictional interaction to rapidly move the log 120.

The insert 170 and/or buffer 320 in some embodiments may comprise foamed and/or unfoamed material, such as polyurethane. For a lightweight insert 170, the insert 170 can be formed of low density foam, medium density foam, or high density foam based on the end use. The density of the foam can be selected based on the desired overall weight of the insert 170.

In some embodiments, the buffer 320 comprises mostly a non-metal material. In such embodiments, the buffer 320 provides localized deformation that helps protect the log 120, even if the base 330 is formed of a hard, rigid material. For example, the buffer 320 can be made of a compliant polymer, and the base 330 can be made of a metal, such as steel. The buffer 320 and base 330 can be formed of a similar material or different materials. In some embodiments, the buffer 320 comprises a first material and the base 330 comprises a second material that is substantially less compliant than the first material.

Additionally or alternatively, the buffer 320 can be formed, in whole or in part, of a high wear material. In some embodiments, for example, polyesters, polyurethane, and the like can provide a high wear-resistant buffer 320 suitable for repeated interaction with logs. The strength, wear resistance, compressibility, and material properties of the materials selected to form the inserts 170 can be determined based on the properties of the logs, processing speeds, desired forces for moving the logs, and other operating criteria that affect the debarking process. One of ordinary skill in the art can determine the appropriate combination of material type, thickness, and shape to achieve the desired physical interaction with the logs.

With reference to FIG. 11, the illustrated base 330 includes a first elongate base element 370, a second elongate base element 372, and a central base portion 380 interposed between the first and second elongate base elements 370, 372. To protect at least a portion of the flute assemblies 160, the base 330 of FIG. 11 also includes an outwardly extending flange 390. As shown in FIG. 4, the flange 390 can overlay the upper edges of the anchor members 210, 212. As such, the flange 390 prevents the log 120 from contacting and bearing against the anchor members 210, 212. In the illustrated embodiment of FIG. 4, the flange 390 has a width that is generally equal to the widths of the anchor members 210, 212. However, other widths are also possible.

To assemble the insert 170, the mounting portion 340 of the buffer 320 can be placed within the base receiving portion 386 of the base 330. A bottom surface 400 of the buffer 320 can engage an upper surface 402 of the receiving portion 386. Sidewalls 406, 408 of the mounting portion 340 can abut against sidewalls 410, 412 of the receiving portion 386.

To lock the buffer 320 to the base 330, protuberances 420, 422 of the base 330 can be received within recesses 430, 432, respectively, of the buffer 320. In this manner, the buffer 320 can be keyed to the base 330. To further minimize or eliminate relative movement between the buffer 320 and base 330, an upwardly extending fastener receiving portion 440 of the base 330 can be received within the aperture 358 of the buffer 330. When assembled, the fastener 244 of FIG. 5 can extend through the aperture 358 and portion 440 and pull the buffer 320 against the base 330 to keep the protuberances 420, 422 in the corresponding recesses 430, 432. Other keying arrangements can also be used.

Figure 13:
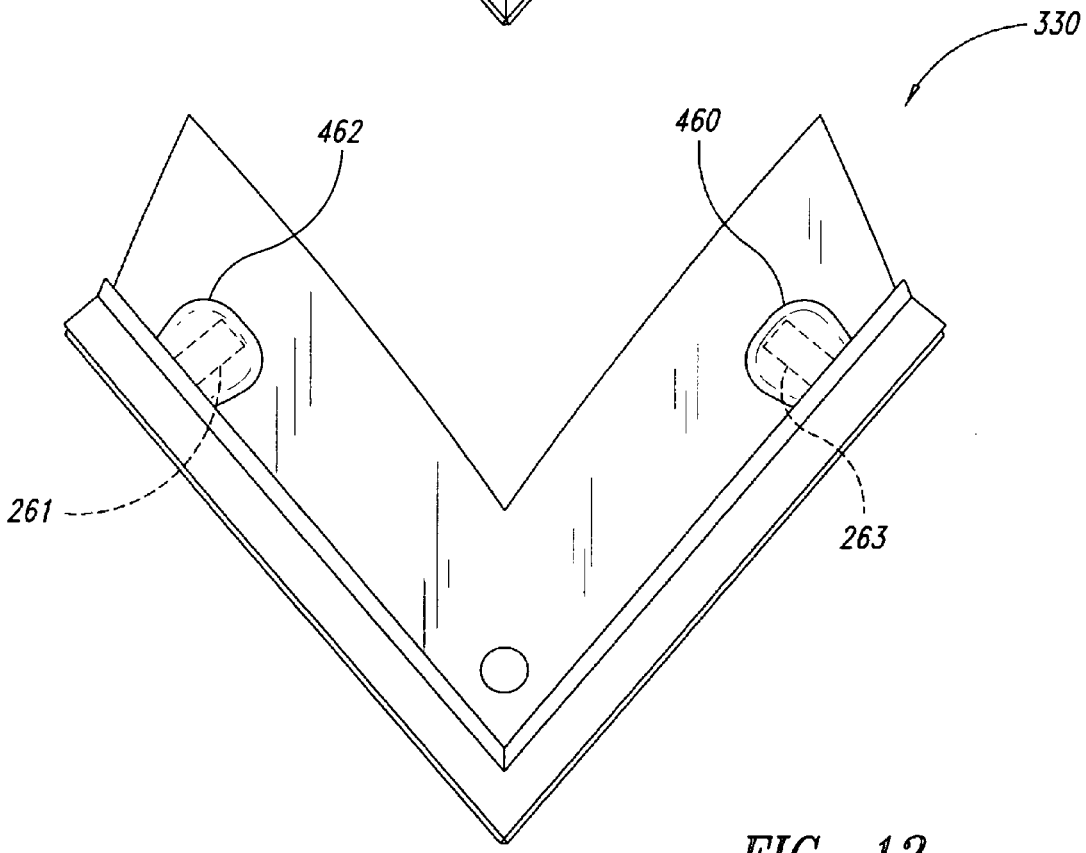
FIG. 13 is a bottom elevational view of the base of FIG. 11.

Fastener receiving portions 460, 462 of the base 330 of FIG. 13 can threadably engage the fasteners 242, 246 (see FIG. 5). To install the insert 170, internally threaded holes 261, 263 of the fastener receiving portions 242, 246 can be registered with corresponding through-holes in the anchor member 210, 212. The fasteners 242, 246 can then be inserted through corresponding through-holes in the anchor member 210, 212 and threadably engage the corresponding threaded holes 261, 263.

Because logs repeatedly strike and bear against the buffer 320, the buffer 320 may become deformed, worn, roughened, or otherwise damaged, especially after extended use. Advantageously, the buffer 320 can be conveniently replaced such that the base 330 can be reused with another buffer. The base 330 can remain attached to the roller assembly 110 during the replacement process.

The entire insert 170 can also be replaced, as needed or desired. In such embodiments, the buffer 320 can be permanently coupled to the base 330. For example, adhesives, welds, or other permanent coupling means, alone or in combination with one or more fasteners, can be used to permanently couple the buffer 320 to the base 330.

Although the illustrated inserts 170 are removable, the inserts 170 in other embodiments can be permanently coupled to the roller assembly 110. For example, the base 330 can be welded, bonded, or otherwise affixed to the roller assembly 110. In such embodiments, the buffer 320 can be removably coupled to the base 330 for convenient buffer replacement. In other such embodiments, the buffer 320 can be permanently coupled to the base 330 to ensure that the buffer 320 remains attached to the base 330 during prolonged use. Thus, if the inserts 170 become worn, the entire roller assembly 110, or a portion thereof, can be easily replaced.

In operation, the log 120 can be fed into the simultaneously rotating roller assemblies 110, 112. As the end 121 of the log 120 comes into contact with the inserts 170, the buffers 320 can engage and pull the log 120 along the processing line 175. To enhance performance, the buffers 320 may deform and absorb energy thereby dampening vibrations and cushioning the end 121.

Because the buffers 320 extend radially outward beyond the flute assemblies 160, logs of different sizes and geometries can be processed by the apparatus 100. The distance between the roller assemblies 110, 112 can be increased or decreased to decrease or increase, respectively, the compressive forces applied to the inserts 170 and log 120. The distance that the inserts 170 extend beyond corresponding adjacent flute assemblies 160 can be selected based on the dimensions of the logs being processed, material properties of the buffer 320 (e.g., compressibility, wear resistance, and the like), and other operating parameters known in the art.

If the buffer 320 is compressed a sufficient amount, the log 120 can engage the flange 390 of the base 330. Even so, the flange 390 protects the anchor members 210, 212 from bearing against the outer surface of the log 120. As such, the inserts 170 can cooperate to form a somewhat continuous annular surface about the entire roller assembly 110. As the log 120 is moved lengthwise along the roller assemblies 110, 112, it remains in generally continuous contact with the inserts 170, thereby prolonging the life of the underlying fluted rolls.

Figure 14:
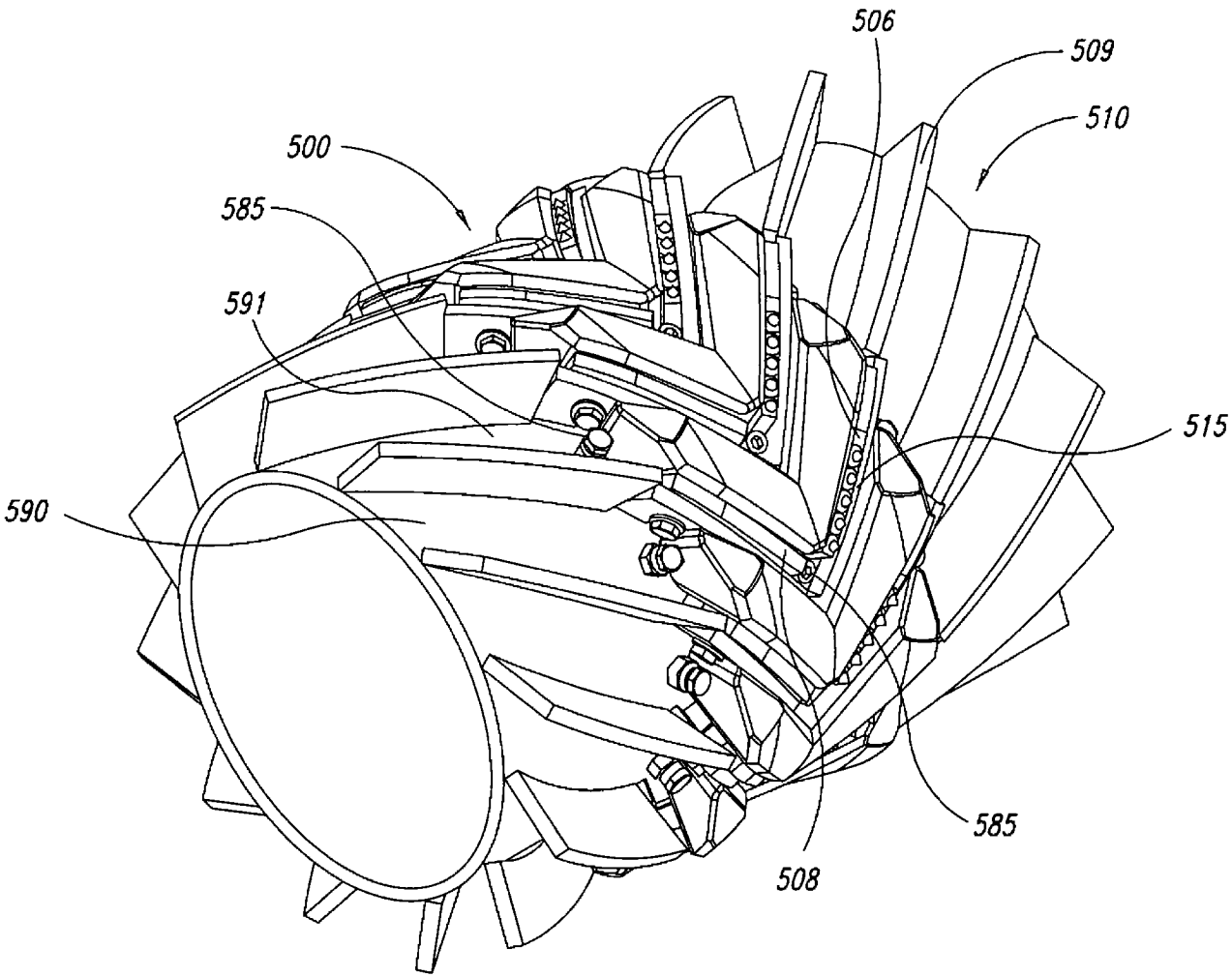
FIG. 14 is a pictorial view of a roller assembly of a debarker apparatus, according to one embodiment.

FIG. 14 shows an array of replaceable flute inserts 500 carried by a roller assembly 510. Pairs of intermediate flute elements 506, 508 are interposed between the inserts 500 and flute assemblies 509 of the roller assembly 510. The roller assembly 510 and its components are generally similar to the roller assembly 110 and its components, except as further detailed below.

The intermediate flute elements 506, 508 can serve as the primary load bearing elements of the roller assembly 510, thus prolonging the working life of other components of the roller assembly 510. Once the flute elements 506, 508 become damaged or worn, they can be conveniently replaced.

Each of the intermediate flute elements 506 includes a plurality of traction elements 515 whereas the intermediate flute element 508 has a bare upper surface. The intermediate flute elements 506, 508 (alone or in combination with the flute inserts 500, flute assemblies 509, or both) can effectively grip and propel a log, and can be similar to or the same as the flute elements disclosed in U.S. Pat. Nos. 6,253,813 and 6,422,277, which are hereby incorporated by reference in their entireties.

Figure 15:
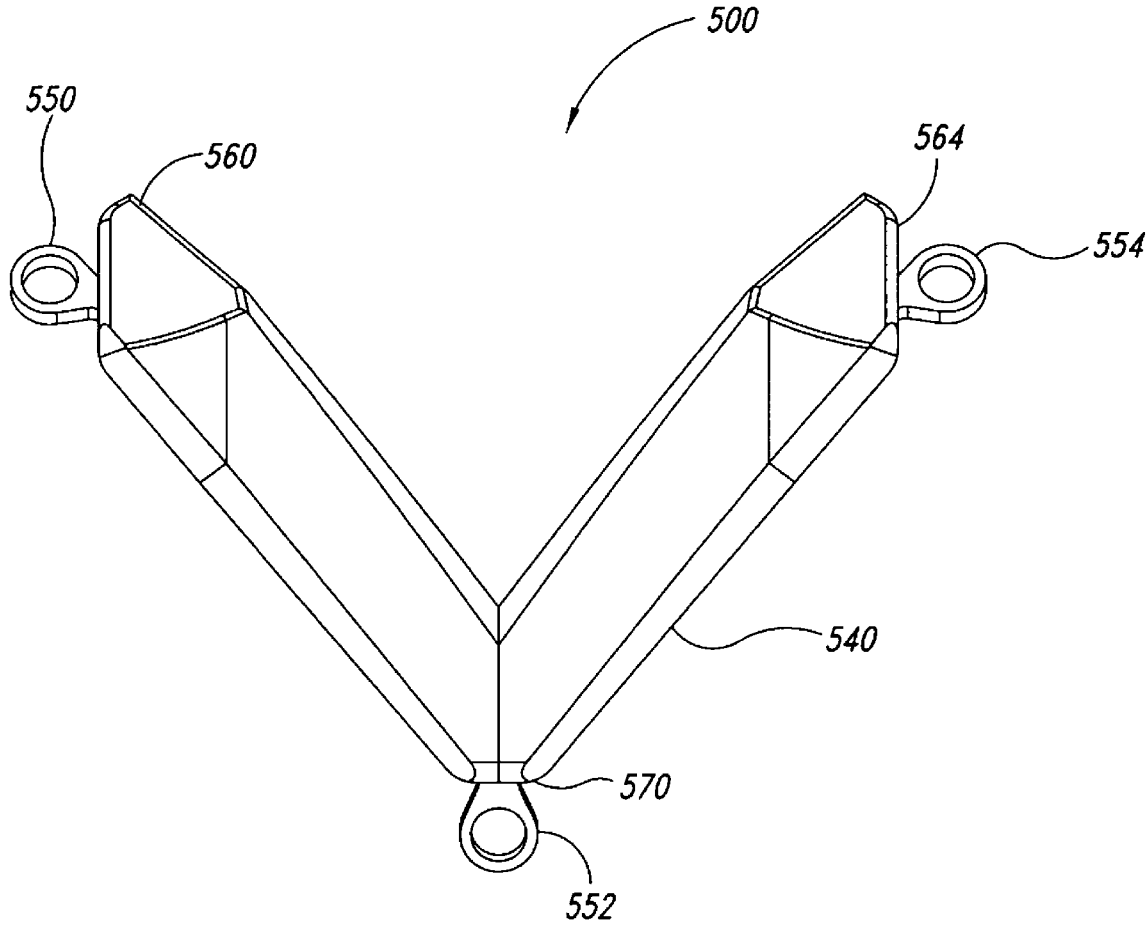
FIG. 15 is a plan view of an insert having a plurality of mounting features used to mount the insert on a roller assembly, according to one embodiment.
Figure 16:
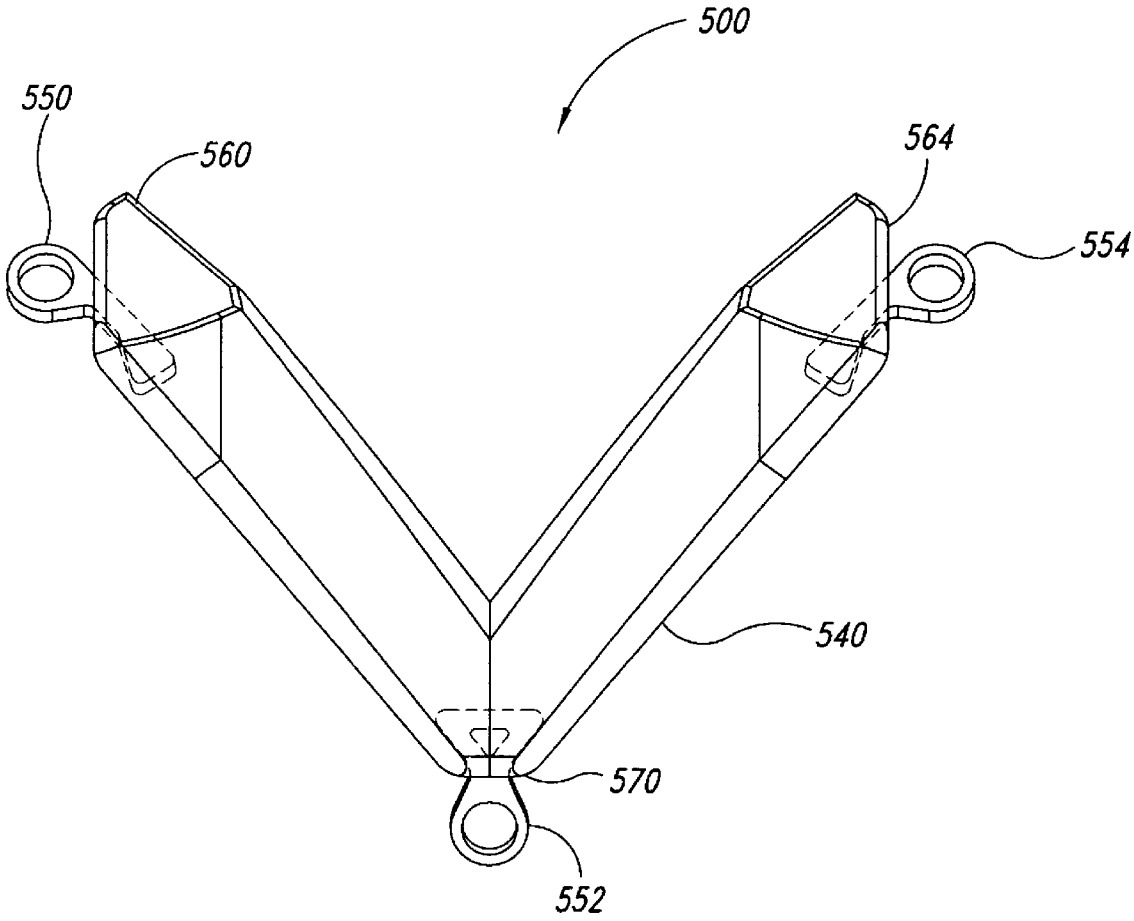
FIG. 16 is a plan view of the insert of FIG. 15, where embedded ends of the mounting features are shown in phantom.

With reference to FIGS. 14 to 16, the insert 500 includes an integrally formed buffer 540 and a plurality of outwardly protruding mounting features 550, 552, 554. As shown in FIGS. 15 and 16, the mounting features 550, 554 are disposed at opposing ends 560, 564 of the buffer 540. The mounting feature 552 is disposed at a central region 570 of the buffer 540. The mounting features 550, 554 can be generally similar to each other and, accordingly, the following description of one of the mounting features applies equally to the other, unless indicated otherwise.

Figure 17:
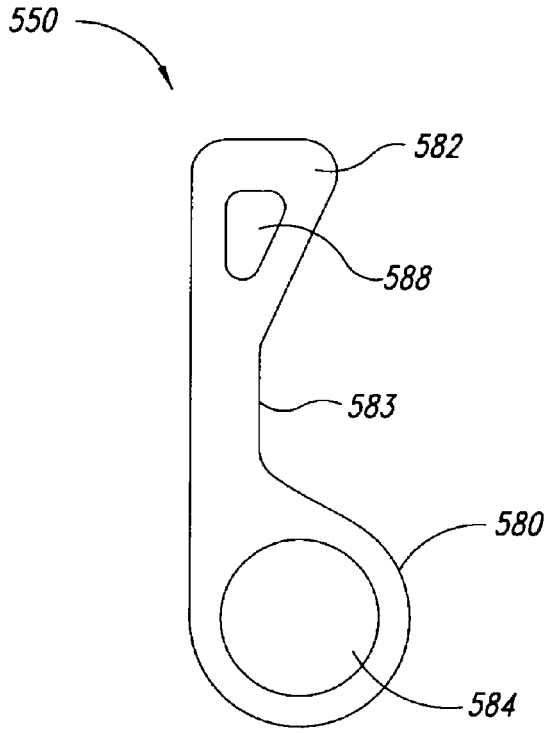
FIGS. 17 and 18 are top elevational views of the mounting feature of the insert of FIG. 15.

The mounting feature 550 of FIG. 17 has a fastener receiving end 580, a buffer end 582, and a mounting feature main body 583 extending between the fastener receiving end 580 and the buffer end 582. The fastener receiving end 580 has an aperture 584 configured to receive a fastener 585, as shown in FIG. 14.

The buffer end 582 has a through hole 588 to increase the pull-out strength of the installed mounting feature 550. If the buffer 540 is formed through a molding process (such as an injection molding process or overmolding process), molded material can extend through the through hole 588 so as to effectively lock the mounting feature 550 to the insert 500. Other types of coupling arrangements can also be used.

Figure 18:
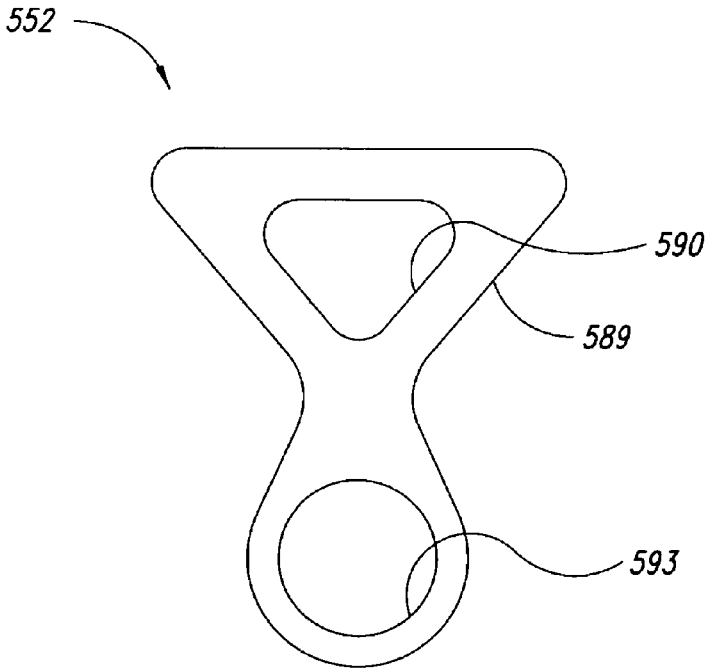

The mounting feature 552 of FIG. 18 can be similar to the mounting features 550, 554, except as further detailed below. A buffer end 589 of the mounting feature 552 is generally larger than the buffer end 582 of FIG. 14. The enlarged buffer end 589, with an enlarged through hole 590, can provide a greater pull-out strength as compared to the mounting feature 550 of FIG. 17.

When installed, the mounting features 550, 552, 554 can effectively reduce, limit, or substantially eliminate unwanted movement of the insert 540 relative to the adjacent components of the roller assembly 110. The mounting features 550, 552, 554 can be formed, in whole or in part, of a relatively strong material, such as metal (e.g., steel, carbon structural steel, titanium, and the like), polymers (e.g., nylon and other high strength polymers), and the like.

The insert 500 of FIGS. 15 and 16 can be formed by a molding process (e.g., an injection molding process, compression molding process, and the like), machining process, or any other suitable manufacturing process, preferably a multi-step process. In some embodiments, for example, a first portion of the buffer 540 can be formed by a molding process. After the mounting features 550, 552, 554 are placed on the first portion of the buffer 540, an overmolding process can be used to cover at least the buffer ends 582, 589. The overmolded material can overlay the mounting features 550, 552, 554, thereby embedding the buffer ends 582, 589. The insert 500 can be formed of the same material or materials as the buffer 320 described herein. In some embodiments, for example, the insert 500 comprises mostly a non-metal material (e.g., a polymer material, foam, and the like). In such embodiments, the insert 500 provides localized deformation that helps protect the log 120.

To couple the flute insert 500 to the roller assembly 110, fasteners 585 can be disposed through corresponding mounting features 550, 552, 554. As shown in FIG. 14, the fasteners 585 can couple the insert 500 directly to a cylindrical roller body 590 of the roller assembly 510. The cylindrical roller body 590 can be a somewhat rigid, strong structure to reduce or limit unwanted movement of the insert 500 relative to the roller assembly 110. When installed, a rear surface of the insert 500 can bear against the outer surface 591 of the cylindrical roller body 590, and when a log is processed, the insert 500 can be sandwiched and compressed between the log and the outer surface 591 of the cylindrical roller body 590.

Other types of mounting features (e.g., tabs, hooks, snap-in members, and the like) or mounting arrangements can be used to mount the inserts 500 to the roller assembly 510. In some embodiments, for example, the buffer 540 itself can have one or more through holes (e.g., countersunk through holes) for receiving fasteners. Fasteners can extend through corresponding through holes to couple the buffer 540 to the cylindrical roller body 590. As such, bolts, fasteners, or other coupling means can directly coupled the insert 500 to the cylindrical roller body 590.

Figure 19:
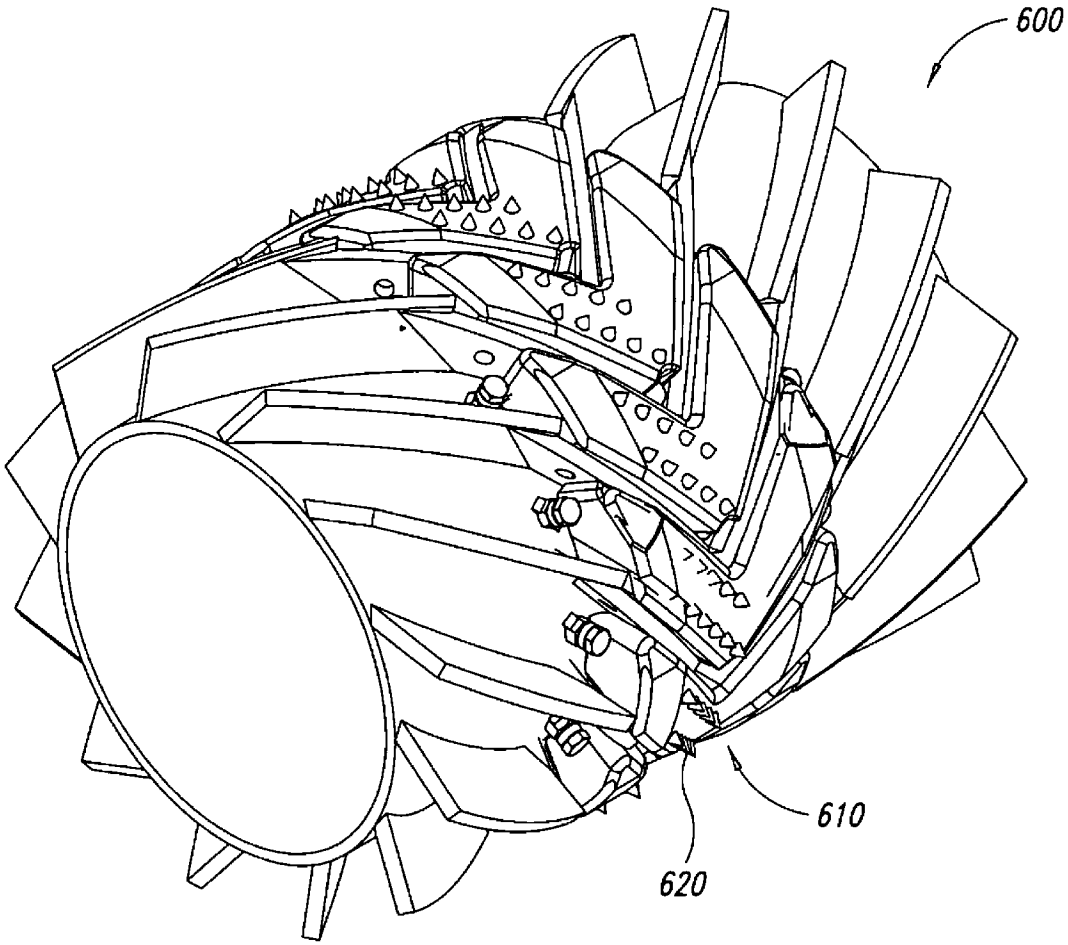
FIG. 19 is a pictorial view of a roller assembly of a debarker apparatus, according to one embodiment.

FIG. 19 shows a roller assembly 600 with inserts 610 that may be generally similar to the inserts 500 of FIGS. 14-16. Each of the inserts 610 has a traction system 620 (illustrated as an array of protruding elements) for providing a desired amount of traction with the log. The traction systems 620 are circumferentially spaced from each other about the roller assembly 600. When the roller assembly 600 rotates, the traction systems 620 can be sequentially brought into contact with a log.

Figure 20:
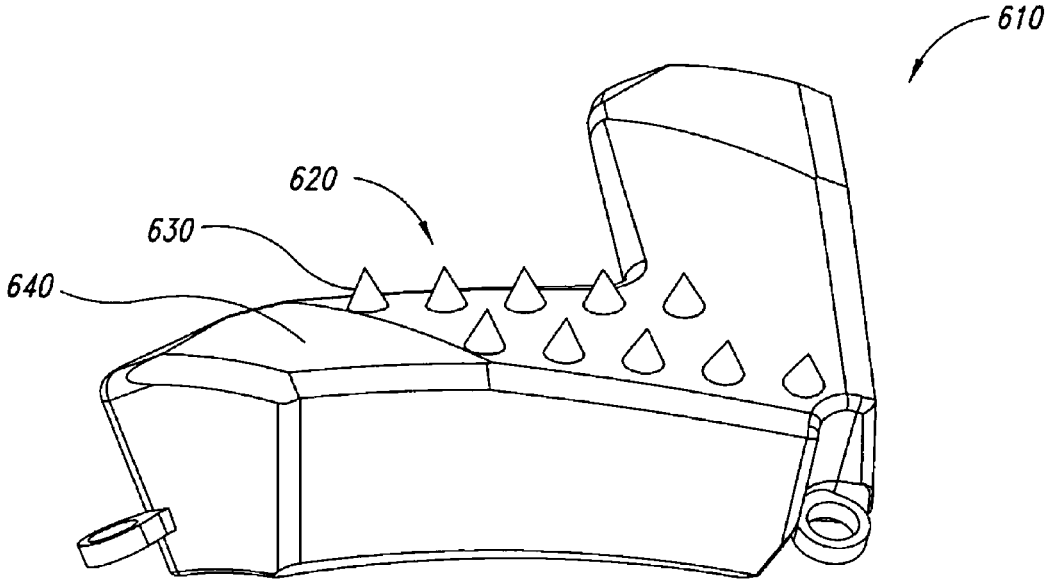
FIG. 20 is an isometric view of an insert having a traction system for engaging logs.
Figure 21:
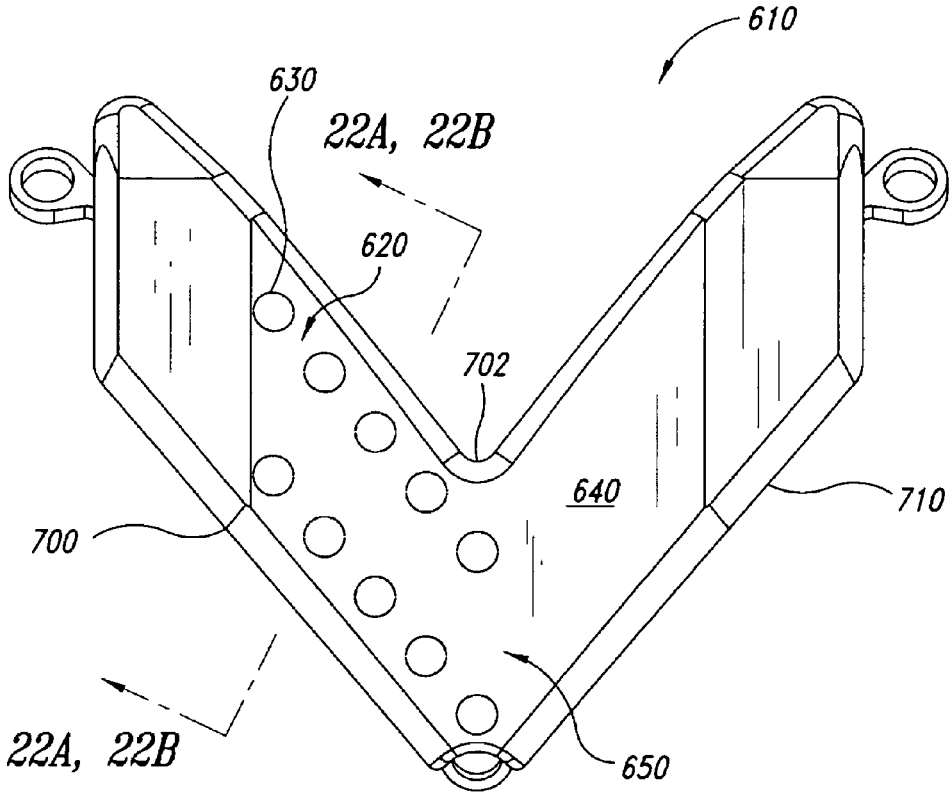
FIG. 21 is a plan view of the insert of FIG. 20.

Referring to FIGS. 20 and 21, the traction system 620 includes an array of traction elements 630 protruding outwardly from an engagement surface 640 and positioned to engage a log. The traction elements 630 provide contact surfaces suitable for bearing repeatedly against wood resulting in desired frictional forces.

The traction elements 630 can be evenly or unevenly spaced along the engagement surface 640. For example, the illustrated traction elements 630 are somewhat evenly spaced from each other so as to form a two-dimensional traction zone 650 (FIG. 21). The illustrated traction zone 650 is formed by two rows of traction elements 630, each row having five traction elements 630. A greater or lesser number of rows with a greater or lesser number of traction elements 630 (or other arrangements entirely) can be used based on various operating parameters, such as desired frictional forces, wood condition, line speed, and the like.

The illustrated traction zone 650 is positioned along an elongate arm 700 and a portion of a central portion 702 of the insert 610. The traction system 620 can securely grip the log whereas the bare elongate arm 710 can slidably engage the log. A log positioned between two of the flute assemblies (e.g., in the arrangement illustrated in FIG. 1) with the inserts 610 can cam along the smooth, bare engagement surfaces 640 of opposing inserts 610 to a central position between the flute assemblies. In the central position, the log can be pressed against the protruding traction elements 630.

Figure 22A:
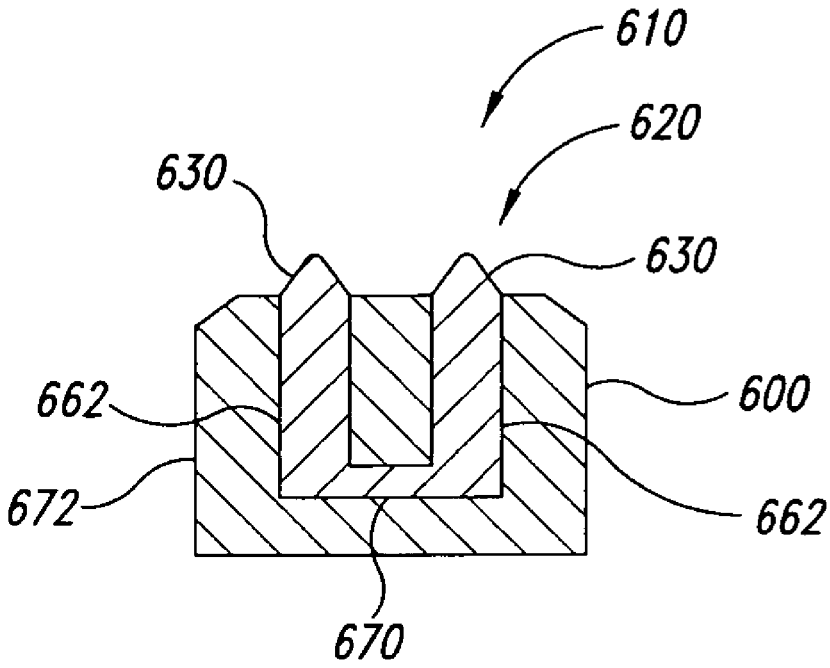
FIG. 22A is a cross-sectional view of the insert of FIG. 21 taken along the line 22A, according to one embodiment.

FIG. 22A shows the partially embedded traction system 620 including a plurality of elongate members 662 extending from an embedded retainer 670. The members 662 extend through and out of a main body 672 of the insert 610. Each of the partially embedded elongate members 662 defines a corresponding traction element 630. For example, each of the illustrated elongate members 662 is a rod that terminates at a corresponding element 630 (e.g., a bullet-shaped tip, conical tip, frusto-conical tip, and the like).

The retainer 670 of FIG. 22A can reduce, limit, or substantially prevent relative movement of the elongate members 662 with respect to the main body 672. When the traction elements 630 strike a log, various types of forces, such as axial forces or moments, can be applied to the elongate members 662. The retainer 670 can provide a reactive force to maintain proper positioning of the elongate members 662, even after extended, repeated use.

The retainer 670 can have one or more holes through which the body 672 can extend to lock the retainer 670 therein. Material extending through the one or more holes can limit or substantially prevent separation of the main body 672 from a central section of the retainer 670. Other types of locking features can also be incorporated into the retainer 670.

Figure 22B:
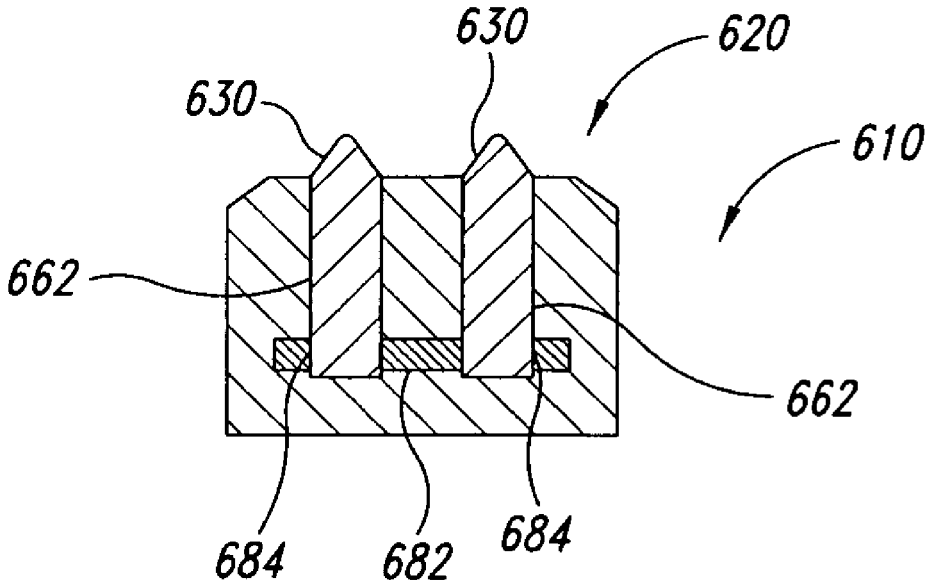
FIG. 22B is a cross-sectional view of the insert of FIG. 21 taken along the line 22B, according to one embodiment.

The traction system 620 can have a one-piece or multi-piece construction. The elongate members 662 of FIG. 22A are integrally formed with the retainer 670 by, for example, a molding process, machining process, and the like. Alternatively, the traction system 620 can have a multi-piece construction. FIG. 22B illustrates the traction system 620 having elongate members 662 and a separate retainer 682. The retainer 682 can have openings 684 that receive corresponding elongate members 662. The illustrated openings 684 are sized to closely receive respective elongate members 662. For example, the elongate members 662 can be coupled to the retainer 682 via an interference fit or press fit. Welding, adhesives, or mechanical fasteners can couple the elongate members 662 to the retainer 682. In some embodiments, the elongate members 662 have external threads that threadably couple to internal threads of the openings 684. Other types of coupling arrangements can also be used.

The traction system 620 can be formed, in whole or in part, of a generally rigid material, such as metals (e.g., steel, tool steel, titanium, aluminum), ceramics, and other high wear materials suitable for striking and bearing against the logs. In use, the end of the log can initially impact the traction elements 630 or the engagement surface 640. The engagement surface 640 can absorb the impact to control the amount of damage, if any, to the leading end of the log. The traction elements 630 can be quickly brought into contact with the log to pull the log through the debarker. The traction elements 630 can dig into the log to grip and propel the log along a processing line.

The traction system 620 can also be used with other inserts described herein. For example, the traction system 620 can be incorporated into the insert 170 of FIG. 5. The traction elements 310 and the traction system 620 can work together to provide a high level of frictional interaction.

A skilled artisan can design the roller assemblies 110, 112 for mounting onto various known debarkers. Various methods and techniques described above provide a number of ways to carry out the invention. Of course, it is to be understood that not necessarily all objectives or advantages described may be achieved in accordance with any particular embodiment described herein. Thus, for example, those skilled in the art will recognize that the methods may be performed in a manner that achieves or optimizes one advantage or group of advantages as taught herein without necessarily achieving other objectives or advantages as may be taught or suggested herein.

Furthermore, the skilled artisan will recognize the interchangeability of various features from different embodiments disclosed herein. Similarly, the various features and acts discussed above, as well as other known equivalents for each such feature or act, can be mixed and matched by one of ordinary skill in this art to perform methods in accordance with principles described herein. Additionally, the methods which are described and illustrated herein are not limited to the exact sequence of acts described, nor are they necessarily limited to the practice of all of the acts set forth. Other sequences of events or acts, or less than all of the events, or simultaneous occurrence of the events, may be utilized in practicing the embodiments of the invention.

Although the invention has been disclosed in the context of certain embodiments and examples, it will be understood by those skilled in the art that the invention extends beyond the specifically disclosed embodiments to other alternative embodiments and/or uses and obvious modifications and equivalents thereof. Accordingly, it is not intended that the invention be limited, except as by the appended claims.

What is claimed is:

1. A roller assembly for a debarker system, the roller assembly comprising:

a roller having a rotary axis;

a plurality of flute assemblies circumferentially spaced about and fixedly coupled to the roller, each adjacent pair of the flute assemblies defines a receiving gap;

a plurality of replaceable flute inserts configured to engage a log and positioned within corresponding receiving gaps, wherein each flute insert extends circumferentially between adjacent flute assemblies and longitudinally along at least a portion of one of the receiving gaps, a compressible portion of the flute insert extends radially outward beyond adjacent flute assemblies such that the compressible portion can first accommodate a periphery of the log when the log engages the roller assembly, the compressible portion extending across at least a portion of the flute insert; and a plurality of fasteners coupling respective flute inserts to the roller, the fasteners extending through the roller and being spaced apart from the flute assemblies.

2. The roller assembly of claim 1 wherein each compressible portion comprises a non-metal material that is elastically deformed when the log moves through the debarker system.

3. The roller assembly of claim 1 wherein each receiving gap comprises a first passageway and a second passageway angled with respect to the first passageway; wherein the flute insert has a first arm extending along the first passageway, a second arm extending along the second passageway, and a central region extending continuously and uninterruptedly between the first arm and the second arm.

4. A roller assembly for a debarker system, the roller assembly comprising:

a roller having a rotary axis;

a plurality of flute assemblies circumferentially spaced about and fixedly coupled to the roller, each adjacent pair of the flute assemblies defines a receiving gap, each receiving gap has a width defined between the adjacent pairs of flute assemblies;

a plurality of replaceable flute inserts configured to engage a log and positioned within corresponding receiving gaps, wherein each flute insert extends across most of a respective width of one of the receiving gaps and extends longitudinally along at least a portion of one of the receiving gaps, a compressible portion of the flute insert extends radially outward beyond adjacent flute assemblies such that the compressible portion can first accommodate a periphery of the log when the log engages the roller assembly, the compressible portion extending across at least a portion of the flute insert, wherein each insert has a resilient buffer that defines the compressible portion; and a plurality of fasteners coupling respective flute inserts to the roller, the fasteners extending through the roller and being spaced apart from the flute assemblies.

5. The roller assembly of claim 4 wherein the resilient buffer comprises a material having a modulus of elasticity less than a modulus of elasticity of steel.

6. The roller assembly of claim 1 wherein the replaceable flute insert has a generally V-shaped configuration.

7. The roller assembly of claim 1 wherein each flute assembly comprises a pair of outer flute members and a pair of abutting inner flute members, the inner flute members are angled to one another and extend between the outer flute members.

8. A roller assembly for a debarker system, the roller assembly comprising:

a roller having a rotary axis;

a plurality of flute assemblies circumferentially spaced about and fixedly coupled to the roller, each adjacent pair of the flute assemblies defines a receiving gap; and a plurality of replaceable flute inserts configured to engage a log and positioned within corresponding receiving gaps, wherein each flute insert extends circumferentially between adjacent flute assemblies and longitudinally along at least a portion of one of the receiving gaps, a compressible portion of the flute insert extends radially outward beyond adjacent flute assemblies such that the compressible portion can first accommodate a periphery of the log when the log engages the roller assembly, the compressible portion extending across at least a portion of the flute insert, wherein at least one insert includes a buffer element comprising the compressible portion which defines a engagement surface positioned radially outward of the flute assemblies next to the buffer element and a base member, the base member is coupled to the buffer element and coupled directly to the roller.

9. The roller assembly of claim 1 wherein the compressible portion of the insert comprises mostly a non-metal material.

10. A roller assembly for a debarker system, the roller assembly comprising:

a roller having a rotary axis;

a plurality of flute assemblies circumferentially spaced about and fixedly coupled to the roller, each adjacent pair of the flute assemblies defines a receiving gap; and a plurality of replaceable flute inserts configured to engage a log and positioned within corresponding receiving gaps, wherein each flute insert extends circumferentially between adjacent flute assemblies and longitudinally along at least a portion of one of the receiving gaps, a compressible portion of the flute insert extends radially outward beyond adjacent flute assemblies such that the compressible portion can first accommodate a periphery of the log when the log engages the roller assembly, the compressible portion extending across at least a portion of the flute insert, wherein at least one insert includes a buffer element comprising the compressible portion which defines a engagement surface positioned radially outward of the flute assemblies next to the buffer element and a base member coupled to the buffer element and and coupled directly to the roller, wherein each of the flute inserts has a buffer and one or more mounting features coupled to the buffer, and wherein the one or more mounting features are configured to mount the buffer on the roller.

11. The roller assembly of claim 1 wherein each of the flute inserts includes a plurality of outwardly protruding traction elements configured and positioned to engage a log.

12. A roller assembly for a debarker system, the roller assembly comprising:

a roller rotatable about an axis;

a plurality of flute assemblies coupled to the roller, each adjacent pair of the flute assemblies defines a gap;

a plurality of replaceable flute inserts configured to engage a log and positioned within corresponding gaps, wherein each flute insert is between adjacent flute assemblies and a portion of the flute insert extends radially outward beyond adjacent flute assemblies, the portion comprises a compressible material that is more compliant than an adjacent portion of the flute assembly such that the portion of the flute insert can first accommodate a periphery of the log when the log engages the roller assembly; and a plurality of fasteners directly coupling respective flute inserts to the roller, the fasteners extending through the roller and being spaced apart from all of the flute assemblies.

13. The roller assembly of claim 12, wherein the flute inserts extend across most of the widths of the respective gaps, the widths are the distances between the flute assemblies defining the gaps.

14. The roller assembly of claim 12, wherein the fasteners extend through the roller and in a radial direction.

* * * * *